US007605575B2

(12) United States Patent
Leutgeb et al.

(10) Patent No.: US 7,605,575 B2
(45) Date of Patent: Oct. 20, 2009

(54) VOLTAGE-SUPPLY CIRCUIT AND METHOD FOR PROVIDING A CIRCUIT WITH A SUPPLY VOLTAGE

(75) Inventors: Thomas Leutgeb, Lieboch (AT); Gerhard Nebel, Immenstadt (DE); Dirk Rabe, Munich (DE); Dietmar Scheiblhofer, Kaindorf (AT); Bernd Zimek, Graz (AT)

(73) Assignee: Infineon Technologies AG (DE)

( * ) Notice: Subject to any disclaimer, the term of this patent is extended or adjusted under 35 U.S.C. 154(b) by 256 days.

(21) Appl. No.: 11/743,915

(22) Filed: May 3, 2007

(65) Prior Publication Data

US 2007/0257646 A1 Nov. 8, 2007

(30) Foreign Application Priority Data

May 3, 2006 (DE) ..... 10 2006 020 561

(51) Int. Cl.
*G05F 1/40* (2006.01)
*G05F 1/56* (2006.01)

(52) U.S. Cl. ..... 323/285; 323/282

(58) Field of Classification Search ..... 323/265, 323/266, 268, 271, 282, 284, 285, 349–351
See application file for complete search history.

(56) References Cited

U.S. PATENT DOCUMENTS

| | | | | |
|---|---|---|---|---|
| 5,838,145 | A * | 11/1998 | Poon et al. | 323/266 |
| 6,262,874 | B1 * | 7/2001 | Stoll et al. | 361/160 |
| 7,268,527 | B2 * | 9/2007 | Horner | 323/285 |
| 7,411,376 | B2 * | 8/2008 | Zhang | 323/277 |
| 2005/0127968 | A1 | 6/2005 | Berger et al. | |

FOREIGN PATENT DOCUMENTS

| | | | |
|---|---|---|---|
| DE | 41 23 416 | A1 | 1/1993 |
| DE | 198 12 920 | A1 | 12/1999 |
| DE | 103 45 235 | A1 | 4/2005 |

* cited by examiner

*Primary Examiner*—Matthew V Nguyen
(74) *Attorney, Agent, or Firm*—Dickstein, Shapiro, LLP.

(57) ABSTRACT

A current-supply circuit includes a regulation transistor. The regulation transistor is formed to regulate, based on a first supply voltage present on a first supply-voltage feed line, a second supply voltage present on a second supply-voltage feed line. The regulation transistor provides a supply current to the second supply-voltage feed line. The voltage-supply circuit further includes an operating-point determiner, which is formed to determine, based on information that is a measure for the supply current, whether the regulation transistor is at a low operating point at which the supply current is below a determined current. The voltage-supply circuit further includes a preventer that is formed to prevent, starting from the low operating point, a rise of the supply current by at least a predetermined current amount from occurring within a predetermined period.

19 Claims, 17 Drawing Sheets

VOLTAGE-SUPPLY CIRCUIT AND METHOD FOR PROVIDING A CIRCUIT WITH A SUPPLY VOLTAGE

CROSS-REFERENCE TO RELATED APPLICATION

This application claims priority from German Patent Application No. 102006020561.8, which was filed on May 03, 2006, and is incorporated herein by reference in its entirety.

TECHNICAL FIELD

This invention relates generally to a voltage-supply circuit and a method for providing a circuit with a supply voltage, in particular to an improved voltage supply through a stepwise load change, an improved voltage supply through a freely programmable current sink and a programmable load circuit with a current hysteresis.

BACKGROUND

In many electronic circuits, for example also in smart cards, dedicated voltage regulators generate a stable tension for the system. Load changes in the system exert a strain on the voltage regulator, which, because of the regulator characteristic of e.g. an N-regulator, can cause temporary collapses of the supply voltage. If the voltage collapses too much, an error-free operation of the circuit or the current-fed system is no longer guaranteed.

In intelligent cards (smart cards), e.g. the supply voltage is in addition monitored by sensors, which, in the event the voltage falls outside the permissible range, reset the system.

FIG. 16 shows by way of an example a graphic representation of a voltage collapse of a regulator (voltage regulator) of a chip card (e.g. a smart card) at a load change.

The graphic representation of FIG. 16 is designated in its whole by 1600. A first graphic representation 1610 shows a voltage evolution 1620 over time of a regulator voltage present at an output of a voltage regulator. On an abscissa 1630 is shown the time. An ordinate 1632 describes a voltage at the output of the regulator, thus e.g. at an internal (e.g. internal with respect to the chip card) supply-voltage feed line. A second graphic representation 1650 describes an evolution of a current provided by the regulator. On an abscissa 1680 is, here too, shown the time, while a corresponding abscissa 1682 represents a current provided by the regulator.

Furthermore, the second graphic representation 1650 shows an evolution 1690 of the current. At one moment, the current rises abruptly from an initial value to a final value. Thereupon the voltage present at the output of the regulator drops. The voltage present at the output of the regulator 1620 then rises again with a time constant and approaches the stationary final value.

Under abrupt change of the current should be understood a change of the current that occurs faster than the time constant of the regulator. In other words, a "more abrupt" rise of the current occurs within a period that is shorter than the period in which the regulator can readjust according to the load change. A rise of the current can however also already be considered as abrupt when the rise occurs faster than during the time constant occurring at the restoring of the output voltage originally present at the regulator.

The time constant for the drop of the output voltage present at the regulator or for the rise of the output voltage present at the regulator can be defined e.g. in that within the time constant the deviation from the minimum value (at a drop of the output voltage) or the stationary final value (at a rise of the output voltage) decreases to 1/e times the initially present deviation.

From the graphic representations 610, 650 in FIG. 16, one can thus see that the regulator voltage at the output of the regulator collapses at the load change, starting from an initial stationary value. The collapse occurs with a first time constant of the regulator, and the recovery of the regulator voltage to the stationary value occurs with a second time constant.

According to the state of the art, the collapse of the supply voltage at a load change shown in FIG. 16 is monitored only by means of special sensors. When the voltage drops below the minimum permissible supply voltage, the sensors suppress the system clock pulses of a switching arrangement fed by the regulator until the supply voltage has recovered through automatic readjusting of the regulator. The described mechanism however necessitates some clock pulses (system clock pulses) until it becomes operative, since it is an integrative mechanism. A certain period or number of system clock pulses is namely necessitated to observe the supply voltage or synchronize clock-pulse suppression.

The described mechanism is in addition inoperative for power consumers that do not permit suppressing clock pulses.

Thus, it should be noted that according to the state of the art a reaction to a load change only occurs when a collapse of the supply voltage present at the output of the regulator below a predetermined threshold value is identified. It has proven that according to the state of the art voltage collapses cannot be optimally minimized. According to the state of the art, the threshold value could of course be increased, however, as a result system clock pulses would then more often—also unnecessarily—be suppressed, whereby the system performance would drop.

SUMMARY

According to an embodiment, a voltage-supply circuit may have: a regulator circuit, which is connected between a first supply-voltage feed line and a second supply-voltage feed line, and which is formed to regulate, based on a first supply voltage present on the first supply-voltage feed line, a second supply voltage present on the second supply-voltage feed line, the regulator circuit being formed to provide a supply current to the second supply-voltage feed line; an operating-point determiner, which is formed to determine, based on information that it is a measure for the supply current, whether the regulator circuit is at a low operating point at which the supply current is below a determined value, wherein at a supply current below the determined value the second supply voltage would temporarily fall in amount below a predetermined permissible minimum voltage value below which a reliable operation of a circuit provided with the second supply voltage is not guaranteed if the current present on the second supply-voltage feed line would rise by a predetermined current amount within a predetermined period; and a preventer, which is formed to prevent, starting from the low operating point, a rise of the supply current by at least the predetermined current amount from occurring within the predetermined period.

According to another embodiment, a method for providing a circuit with a supply voltage using a regulation transistor, which is connected between a first supply-voltage feed line and a second supply-voltage feed line, and which is formed to regulate, based on a first supply voltage present on the first supply-voltage feed line, a second supply voltage present on the second supply-voltage feed line, the regulation transistor providing a supply current the second supply voltage, may have the steps of: determining whether the regulation transistor is at a low operating point, based on information that is a measure for the supply current, the regulation transistor being at a low operating point when the supply current is below a predetermined value, wherein, at a supply current below the predetermined value, the second supply voltage would temporarily fall in amount below a predetermined permissible minimum voltage value below which reliable operation of a circuit provided with the second supply voltage is not guaranteed if the current present on the second supply-voltage feed line rose by a predetermined current amount within a predetermined period; and preventing, starting from the low operating point, a rise of the supply current by at least the predetermined current amount from occurring within the predetermined period.

This invention creates a voltage-supply circuit with a regulation circuit or regulator circuit connected between a first supply-voltage feed line and a second supply-voltage feed line. The regulation circuit is formed to regulate, based on a first supply voltage present on the first supply-voltage feed line, a second supply voltage present on the second supply-voltage feed line. To this end, the regulation circuit is formed to provide a supply current to the second supply-voltage feed line. The voltage-supply circuit according to invention includes furthermore operating-point determination circuit, which is formed to determine, based on information that is a measure for the current-supply current, whether the regulation circuit is at a low operating point. At a low operating point the supply current provided by the regulation circuit is lower than a predetermined current value. If the regulation circuit provides a current that is below the given current value, the second supply voltage would temporarily drop, as to its amount, below a predetermined permissible minimum voltage value if the current present on the second supply-voltage feed line would rise within a predetermined period by a predetermined current amount. If the supply voltage would furthermore drop below the predetermined permissible minimum voltage value, a reliable operation of a circuit provided with the second supply voltage would not be guaranteed. The voltage-supply circuit according to the invention includes furthermore prevention circuit, which is formed to prevent a rise of the supply current, starting from the low operating point, by the predetermined current amount from occurring within the predetermined period.

In other words, the prevention circuit is formed to prevent the supply current, starting from the low operating point, from rising so fast that the regulation circuit can no longer readjust fast enough the regulated second supply voltage, so that the second supply voltage would fall below the minimum voltage value.

The central thought of this invention is that it is advantageous to monitor the operating point of the regulation circuit and, in the case the regulation circuit is at a low operating point at which it could no longer compensate a rise of the supply current exceeding a determined value occurring within the predetermined period, to prevent a corresponding rise of the supply current that cannot be compensated. On the other hand, if the regulation circuit is at a high operating point, thus at an operating point at which the regulation circuit can compensate a rise of the supply current without the second supply voltage falling below the permissible minimum voltage value, the prevention circuit is no longer operative or does no longer prevent a change of the supply current.

In other words, at a low operating point of the regulation circuit would thus occur, by definition, at a determined load change or at a determined rise of the supply current, a larger voltage collapse of the regulated second supply voltage than at a high operating point.

It is therefore the central thought of this invention that it is advantage to monitor the operating point of the regulation circuit and, in the case the regulation circuit is at a low operating point, to prevent a rise of the supply current that cannot be compensated. On the other hand, if the regulation circuit is at a high operating point, thus at an operating point at which a load change (e.g. a load rise) causes, because of the regulation characteristic, a smaller voltage collapse (than at the low operating point) without the second supply voltage falling below the permissible minimum voltage value (also called load change that can be compensated—with sufficiently small voltage collapse—or load rise that can be compensated—with sufficiently small voltage collapse), the prevention circuit is no longer operative or does no longer prevent a change of the supply current.

Through the concept according to invention it is thus guaranteed that an inadmissibly high increase of the supply current within the predetermined period or within the predetermined time interval (thus an abrupt rise of the supply current) is prevented at the very moment at which the operating-point regulation circuit identifies that the regulation circuit is at the low operating point.

The concept according to the invention has the advantage that no inadmissibly high collapses below the permissible minimum voltage value occur on the second supply voltage, whereby it is guaranteed that the circuit supplied with the second supply voltage operates reliably.

It should be noted, furthermore, that through the concept according to invention an inadmissibly high increase of the supply current, which would result into a collapse of the second supply voltage is prevented, provided the regulation circuit is at the low operating point. According to this invention, the operating-point regulation circuit determines, already before the occurrence of a rise of the supply current, based on the information that is a measure for the current-supply current, whether the regulation circuit is at a critical low operating point. Thus, the prevention circuit can become preventively operative in order to prevent in such a case an inadmissibly high current rise. The described procedure is contrary to conventional solutions in which a rise of the supply current is identified only based on a drop of the second supply voltage. Thus, with conventional solutions, an inadmissibly high rise of the supply current cannot be preventively opposed. This invention allows however preventing an inadmissibly high rise of the supply current at the very moment at which the regulation circuit is at a low operating point.

This invention has thus furthermore the advantage that a rise of the supply current is limited only when such is necessary.

This invention has thus generally the advantage that a circuit provided with the second supply voltage can also operate reliably when a power consumption of the circuit is subjected to strong fluctuations.

In an exemplary embodiment, the regulation circuit includes a regulation transistor, which is connected between the first supply-voltage feed line and the second supply-voltage feed line.

In an exemplary embodiment of this invention the operating-point regulation circuit is formed to derive from the supply current a current that is a scaled image of the supply current, in order to compare the derived current with a predetermined reference current and to detect a presence of a low operating point of the regulation transistor when the derived current is smaller than the reference current. It has namely been proven that the supply current flowing through the regulation transistor is a measure for whether the regulation transistor is at a low operating point. If the current flowing through the regulation transistor is small, this indicates that the regulation transistor cannot compensate a fast increase of the supply current by the predetermined current occurring within the predetermined period, so that in the event of a corresponding rise of the supply current the second supply voltage would fall below the predetermined permissible minimum voltage value. However, if the supply current provided by the regulation transistor is sufficiently high, it can be assumed that the regulation transistor could also compensate a larger increase of the supply current without the second supply voltage falling below the permissible minimum voltage value. The described relations result from the characteristic curve of the regulation transistor in connection with a dynamic analysis of same.

It is furthermore advantageous to use not the supply current itself, but a scaled image of the supply current for a comparison with the reference current. The scaled image of the supply current can e.g. be clearly smaller than the supply current itself, so that the reference current used for the comparison can also be selected accordingly small. This results into a current-saving possibility of performing the comparison.

In another exemplary embodiment the operating-point determination circuit includes an operating-point determination transistor, which is structured similar to the regulation transistor and which is so scaled with respect to the regulation transistor that a current flowing through the operating-point determination transistor is, at identical voltages present at the regulation transistor and at the operating-point determination transistor, except for parasitic deviations, proportional to the supply current. The current flowing through the operating-point determination transistor is advantageously smaller than the supply current, in order to allow a current-saving determination of the operating point of the regulation transistor. Furthermore, the regulation transistor and the operating-point determination transistor are advantageously interconnected so that at least a voltage difference between two terminals is identical in both transistors. This guarantees that the regulation transistor and the operating-point determination transistor operate at substantially identical operating points. Therefore, a current that is a measure for the supply current flowing through the regulation transistor flows through the operating-point determination transistor.

In another preferred exemplary embodiment the operating-point determination circuit includes a capacitor the charging current of which is determined by a difference between the derived current and the reference current. The operating-point determination circuit is in this case formed to decide, based on a capacitor voltage of the capacitor whether the regulation transistor is at a low operating point. A time constant of the regulation transistor or the regulation coupled to the regulation transistor can be copied by the corresponding capacitor. Thus, by using the capacitor the behaviour over time of the regulation transistor is copied, in order to obtain from the capacitor voltage a particularly accurate conclusion on the actual operating point of the regulation transistor or on its ability to compensate a rise of the supply current.

In a further preferred exemplary embodiment the operating-point determination circuit includes a Schmitt trigger, which is formed to receive the capacitor voltage and the output signal of which constitutes information on whether the regulation transistor is at a low operating point. A Schmitt trigger guarantees that the information on the operating point of the regulation transistor is stable over time and adopts a constant value e.g. when short current peaks occur on the second supply-voltage feed line.

In another preferred exemplary embodiment the voltage-supply circuit includes a switchable current sink, which is coupled to the second supply-voltage feed line so that the supply current can be increased through switching on the current sink. The voltage-supply circuit is furthermore formed to receive information on a forthcoming increase of the supply current and to switch on the current sink when information is present that indicates a forthcoming increase of the supply current, and when the regulation transistor is at a low operating point. The voltage-supply circuit is furthermore formed to switch off the current sink in the opposite case.

In other words, the voltage-supply circuit is preferentially formed to switch on the switchable current sink, and thus to increase the supply current flowing through the regulation transistor, at the very moment at which information is present that indicates that the power consumption of the circuit fed with the second supply voltage will increase within a determined foreseeable time interval and the regulation transistor is in addition at a low operating point. Thus, the regulation transistor is brought, before the actual increase of the current necessitated by the current-fed circuit, from the low operating point to a higher operating point at which the regulation transistor can compensate the increase of the current necessitated by the current-fed circuit without the second supply voltage falling below the permissible minimum voltage value.

The concept described has the substantial advantage that the switchable current sink is activated only when an increase of the current necessitated by the current-fed circuit is foreseeable or when the forthcoming increase of the current necessitate by the current-supply circuit is signalled to the current-supply circuit. If the regulation transistor is either not at a low operating point or if no increase of the current necessitated by the current-fed circuit is approaching, the current sink is switched off, and the voltage-supply circuit consumes only a minimum current necessitated.

The current derived by the current sink is furthermore smaller than the forthcoming increase of the current necessitated by the current-fed circuit. Therefore, an activation of the current sink causes only a small collapse of the regulated supply voltage.

In another preferred exemplary embodiment the activating circuit is formed to activate the circuit fed with the second supply voltage so that a current taken up by the current-fed circuit rises within the predetermined period by less than the predetermined current amount when the operating-point determination circuit detects that the regulation transistor is at a low operating point. However, if the operating-point determination circuit detects that the regulation transistor is not at a low operating point, the activating circuit does not act on the current-fed circuit or permits an operation of the current-fed circuit with maximum power consumption. Thus, when the operating-point determination circuit detects that the regulation transistor cannot compensate a determined rise of the supply current, the activating circuit controls the current-fed circuit so that the increase of the supply current within the predetermined period is not larger than the maximum rise of the supply current that can be compensated by the regulation transistor (within the predetermined period).

The activating circuit is advantageously formed to set a clock frequency of the clock pulse provided to the current-fed circuit at a low value when the regulation transistor is at a low operating point. On the other hand, if the regulation transistor is not at a low operating point, the activating circuit advantageously sets the clock frequency of the clock pulse at a high value. Such an activation is advantageous when it can be assumed that the clock frequency of the clock pulse has an influence on a power consumption of the current-fed circuit.

By reducing the clock frequency, it can be achieved that the supply current passing through the regulation transistor increases only by a small current amount as soon as an inactive circuit contained in the current-fed circuit is activated. At a high or full clock frequency the supply current would instead increase by a larger current amount.

In another preferred exemplary embodiment of this invention the activating circuit is formed to block at least one inactive circuit portion (at the time of the blocking) of the circuit fed with the second supply voltage, provided the regulation transistor is at a low operating point, and to release the blocked circuit portion for activation when the regulation transistor is no longer at a low operating point.

In other words, when the operating-point determination circuit detects that the regulation transistor is at a low operating point, the activating circuit outputs control signals to the current-fed circuit, so that no longer all partial circuits of the current-fed circuit can be activated. Thus, only part of the partial circuits contained in the current-fed switching arrangement can be activated when the regulation transistor is at a low operating point. When the regulation transistor is instead at a high operating point or no longer at a low operating point, e.g. all partial circuits contained in the current-fed circuit can be activated, should such be necessitated. Thus, in this case the prevention circuit does not block any partial circuits.

Furthermore, it is e.g. preferred that e.g. an actual subset among a quantity of similar partial circuits (e.g. read amplifiers of a non-volatile memory) is blocked during the blocking process.

The blocking of the partial circuits can occur e.g. by deactivating the supply voltage related to the blocked circuit portions, by blocking an associated clock pulse or by interrupting a signal flow, (e.g. by means of a gate or a switch).

It is thus achieved that the rise of the supply current is limited when the regulation transistor is at a low operating point. In this case, the current-fed circuit can only be activated partly, whereby an excessive rise of the supply current is prevented.

In another preferred exemplary embodiment the voltage-supply circuit according to invention includes a switchable current sink, which is coupled to the supply-voltage feed line so that the supply current can be increased by switching-on the current sink. The current-supply circuit is formed to switch on the switchable current sink when the operating-point determination circuit signals that the regulation transistor is at a low operating point. A current absorbed by the switchable current sink in the switched-on state is chosen so that after switching-on of the current sink the regulation transistor is no longer at a low operating point. In other words, after switching on of the current sink the regulation transistor is at a high operating point, at which the regulation transistor can compensate a larger increase of the supply current than at the low operating point (without the second supply voltage falling below the permissible minimum voltage value).

In other words, by switching on the current sink the operating point of the regulation transistor is shifted so that the regulation transistor can compensate a higher rise of the supply current within the predetermined period than when the current sink is switched off. It should of course be guaranteed that the regulation transistor will not be overloaded with current when activating the current sink, thus that after switching on the current sink the regulation transistor can still provide a sufficient additional current flow, in order to be able to meet a rising electric-current need of the current-fed circuit.

This invention includes furthermore a method for providing a circuit with a supply voltage, in which the steps are performed in a way similar to the above-described voltage-supply circuit.

Preferred exemplary embodiments of this invention are now described in more detail with reference to the enclosed drawings.

BRIEF DESCRIPTION OF THE DRAWINGS

Embodiments of the present invention will be detailed subsequently referring to the appended drawings, in which.

DETAILED DESCRIPTION

Figure 1A:
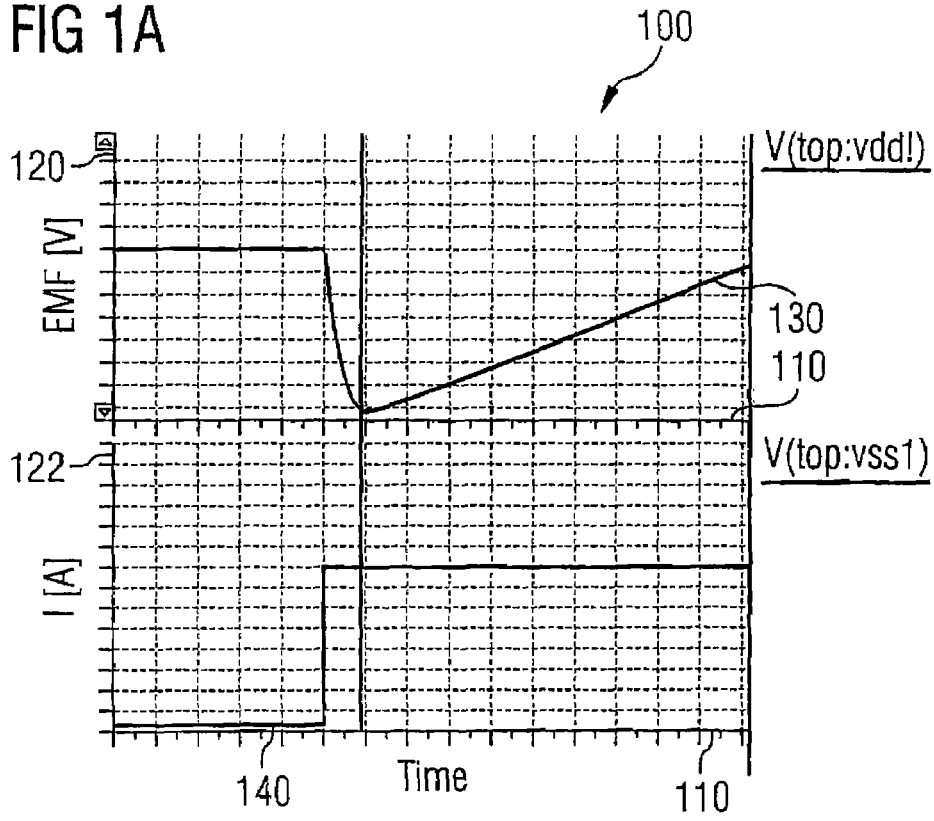
FIG. 1*a* shows a graphic representation of a collapse of a regulator voltage provided by a regulation transistor at a load change.

In order to facilitate an understanding of this invention, the response of a voltage regulator to a load change is now described with reference to FIGS. 1*a,* 1*b,* 1*c* and 2.

It is assumed that from an external supply voltage (hereinafter also called first supply voltage), which is present on a first supply-voltage feed line is generated an internal supply voltage (hereinafter also called second supply voltage), the second or internal supply voltage being present at a second supply-voltage feed line. Between the first supply-voltage feed line and the second supply-voltage feed line is connected a regulation transistor through the load path of which flows a supply current, the supply current being provided to the second supply-voltage feed line. As regards the load path of the regulation transistor, it can be e.g. a drain-source path of a field-effect transistor or a collector-emitter path of a bipolar transistor. The control terminal of the regulation transistor is furthermore connected to a regulation circuit, which receives the second supply voltage and activates the control terminal (typically, the gate terminal or base terminal) of the regulation transistor, in order to achieve that the second supply voltage (in a stationary case) is compensated to a fixed predetermined value, irrespective of the supply current. The corresponding regulation for the second supply voltage, which includes the regulation transistor as adjusting member, has several time constants. A first time constant of the regulation indicates how quickly the regulation responds, i.e., the time the regulation necessitates, in the case of a load increase, to oppose the drop of the second supply voltage (by load increase being understood an increase of the supply current to be provided to the second supply-voltage feed line). The first time constant thus describes the period after a load increase in which the minimum value of the second supply voltage is reached. A second time constant of the regulation indicates the time the regulation necessitates to restore the second supply voltage (at least approximately) to the initial value or to bring a regulation offset, which is defined as the difference between the actual value of the second supply voltage and the final value of the second supply voltage, in amount below a predetermined barrier (wherein the predetermined barrier can be defined e.g. as an absolute value or as a fraction of a maximum regulation offset occurring at the load change).

Very generally considered, it should be noted that at a high load change (increase of the supply current provided by the regulation transistor) at a regulator the regulated second supply voltage collapses. A reason for this collapse can be e.g. an unfavourable operating point of the regulation transistor with a low drain-source voltage (or collector-emitter voltage) or a weak inversion. A voltage collapse can also be caused by the fact that a resistive transistor operating-point is present.

At a load change the control terminal of the regulation transistor (e.g. the gate terminal of the regulation transistor) must be charged or recharged, in order to prevent a voltage drop (of the regulated supply voltage). Recharging occurs through a regulation loop with a time constant within the range of several milliseconds.

The voltage drop depends on the operating point of the regulation transistor. FIGS. 1*a* and 1*b* show graphic representations of a collapse of a supply voltage or regulation voltage provided by a regulation transistor at a load change. FIGS. 1*a* and 1*b* show a comparison between voltage collapses at a different basic load. The graphic representation of FIG. 1*a* is designated, in its whole, by 100. On an abscissa 110 is shown the time. A first ordinate shows a supply voltage provided by the regulation transistor. A second ordinate 122 shows a supply current provided by the regulation transistor. The first graphic representation 100 thus describes a voltage drop, which occurs when using a NMOS transistor (as regulation transistor), for an increase of the current provided by the regulation transistor. The graphic representation 100 shows the voltage and current evolutions based on a simulation of a regulation circuit with an above- described transistor using a VHDL AMS model of the regulator. As can be seen in the graphic representation 100 of FIG. 1*a,* a rise of the supply current provided by the regulation transistor causes a voltage drop, the (second) supply voltage regulated by the regulation transistor dropping.

The corresponding voltage evolution of the regulated (second) supply voltage is designated by 130, and the evolution of the current regulated by the regulation transistor is designated by 140. In the graphic representation 100 of FIG. 1 can furthermore be seen that the minimum value of the voltage is reached about a first time constant after the rise of the current, and that, furthermore, a recovery of the regulated voltage provided by the regulator necessitates a period that is called second time constant.

Figure 1B:
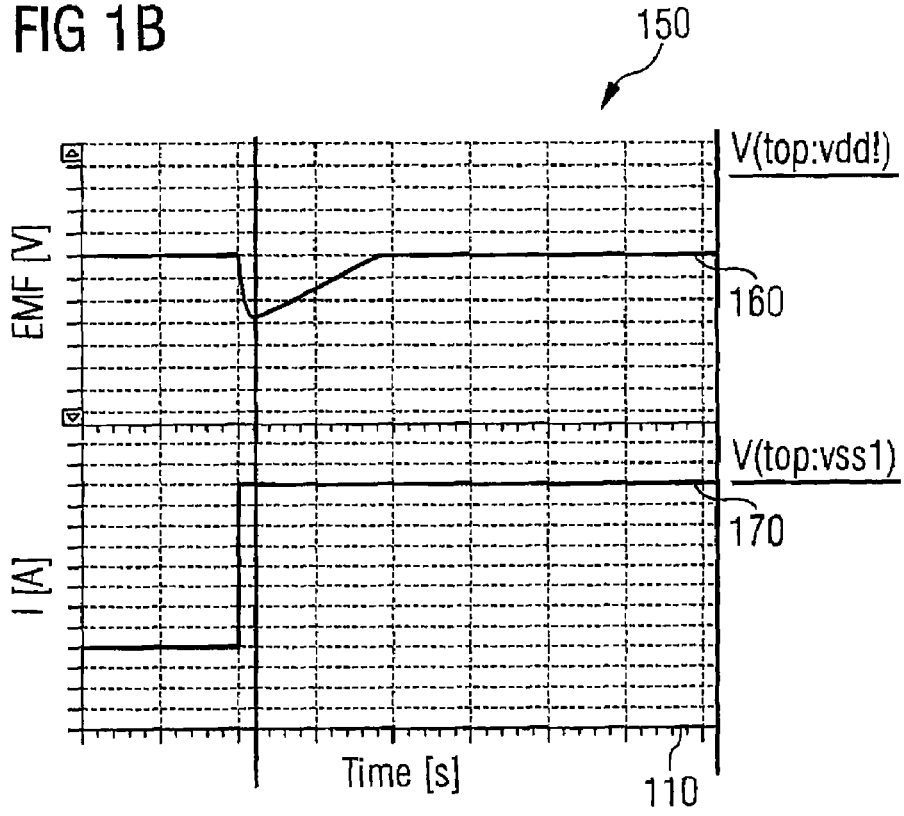
FIG. 1*b* shows a graphic representation of a collapse of a regulator voltage provided by a regulation transistor at a load change.

In a graphic representation 150 of FIG. 1*b* is shown a voltage and current evolution, which is very similar to the evolution shown in the graphic representation 100 of FIG. 1*a*. Therefore, identical coordinate axes in the graphic representation 150 are designated in the same way as in the graphic representation 100. The abscissa of the graphic representation 150 of FIG. 1*a* has another range of values, only relative time differences being however relevant here.

The graphic representation 150 shows a voltage evolution 160 of the (second) supply voltage regulated by the regulation transistor, which belongs to a current evolution 170 of the supply current provided by the regulation transistor. The graphic representation 150 shows a rise of the supply current of about the same amplitude as in the graphic representation 100, but starting from a higher initial current flow. The current rise causes a voltage drop of the supply voltage provided by the regulation transistor, which is smaller than the voltage drop according to the graphic representation 100.

It can thus be noted that a rise of the supply current provided by the regulation transistor causes, starting from a higher initial current flow, a smaller drop of the (second) supply voltage regulated by the regulation transistor than a rise of the same amplitude of the supply current starting from a lower initial current flow. The voltage drop (which occurs at an increase of the supply current) thus depends on the absolute value of the current rise and on the (initial) current present before the rise.

The attention is also drawn here on the fact that in the case shown in the graphic representation 150 a first time constant is defined by the fact that after elapse of same a minimum value of the regulated tension is reached. A rise of the regulated tension back to the equilibrium value occurs with a second time constant.

The attention is drawn, furthermore, on the fact that the rise of the current occurs clearly faster than the two relevant time constants of the regulator for reaching the minimum regulated tension and returning to the equilibrium value. Therefore, in this connection one can also speak of an abrupt current rise.

Figure 1C:
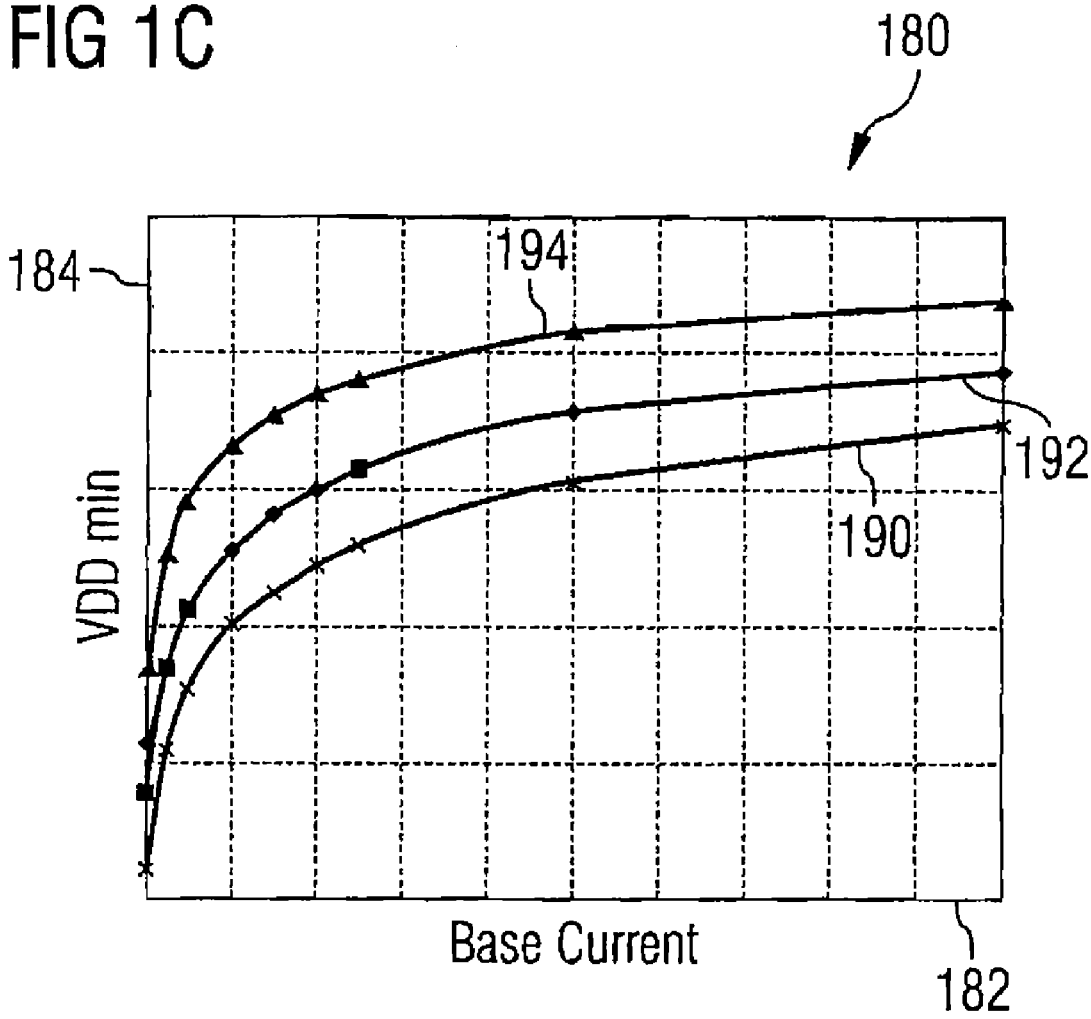
FIG. 1*c* shows a graphic representation of a dependence of a minimum regulation voltage occurring at a load change as a function of a basic current and an amplitude of the load change.

FIG. 1*c* shows a graphic representation, which describes the extent to which the regulation voltage drops at a fast current rise (occurring abruptly, faster than the time constants of the regulator).

The graphic representation 180 of FIG. 1*c* shows a "base current" present on an abscissa 182, which describes the value of the supply current before the (abrupt) rise of the supply current. An ordinate 184 describes furthermore the smallest occurring supply voltage provided by the regulation transistor. A first evolution curve 190 describes the lowest regulated supply voltage occurring at a current rise by a first value as a function of a supply current flowing before the current rise. A second curve 192 shows the same relation at a rise of the supply current by a second value smaller than the first value. A third curve 194 similarly describes the minimum supply voltage present at a rise of the supply current by a third value smaller than the second value. The second evolution curve 192 shows two cases, for different external supply voltages (first supply voltage) present at the regulation transistor.

In other words, the graphic representation 180 FIG. 1*c* shows the dependence of the voltage drop on the base current for three different current peaks. The corresponding voltage drop is the largest when the regulation transistor (before the current increase) is almost switched off (small base current). Above a determined base current the gain that can be obtained by an increase of the base current is less efficient.

In other words, the base current is increased from a smaller value to about the determined base current, the drop of the regulated voltage occurring at a load change can thus be clearly reduced. On the other hand, above a base current of about the determined value only a smaller improvement of the voltage drop occurring at a load change is achieved in the case of an increase of the base current.

Figure 2:
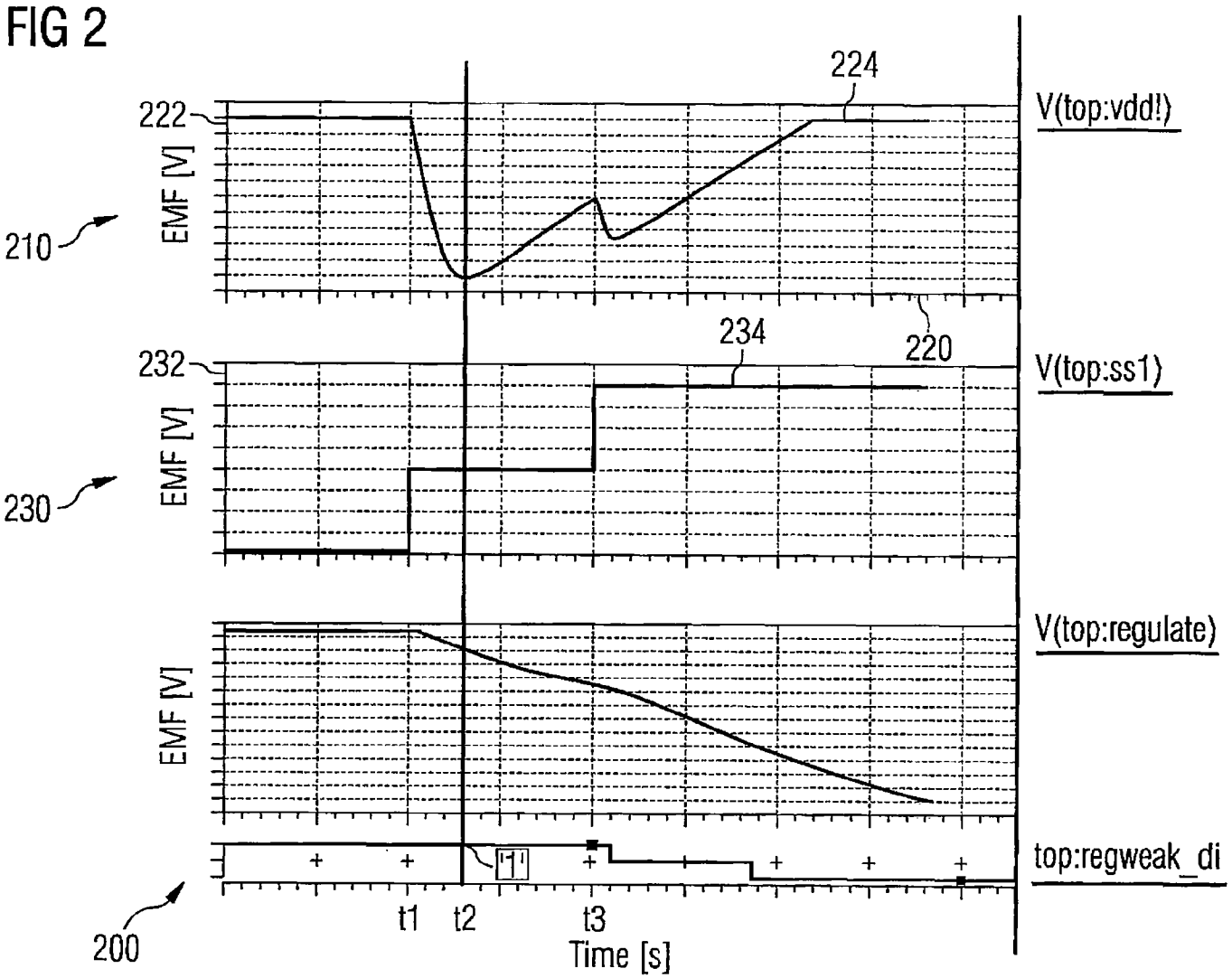
FIG. 2 shows a graphic representation of a voltage evolution of a regulation voltage at a stepwise load change.

FIG. 2 shows, furthermore, a graphic representation of voltage and current evolutions at a stepwise load change. The graphic representation of FIG. 2 is designated, in its whole, by 200. A first graphic representation 210 shows an evolution over time of a regulated voltage provided by a regulation transistor. An abscissa 220 describes the time. On an ordinate 222 is presented the regulated voltage. An evolution curve 224 describes the regulated voltage as a function of the time.

A second graphic representation 230 describes by means of an evolution curve 234 a supply current as a function of the time, an associated ordinate 232 showing the supply current.

The supply current increases at a moment t1. Thereupon the regulated voltage drops until a minimum value is reached. After reaching the minimum value at a moment t2, the regulated supply voltage rises again. At a moment t3 the supply current rises. The regulated voltage then collapses again. Afterwards, the regulated voltage rises again to the stationary final value.

It thus proves that the collapse of the regulated voltage can be reduced by a stepwise increase of the supply current. While e.g. a rise of the current directly or abruptly from an initial value to a final value causes a strong drop of the regulated voltage, through a stepwise increase of the supply current from the initial value to the final value can be achieved that the regulated supply voltage has a smaller fall or collapse.

In short, it can be noted that the extent of the voltage collapse of a regulated voltage provided by a regulation transistor at a load change is substantially determined by the following values:

1. The supporting capacitor of the system, the supporting capacitor describing a capacitor that opposes fluctuations of the regulated supply voltage and that is coupled to a supply-voltage feed line that conducts the regulated supply voltage;
2. The extent of the load jump or the amount by which the supply current provided by the regulation transistor increases; and
3. The operating point of the regulation transistor, thus the amount or the extent of the base load current or base current flowing through the regulation transistor before the load jump.

Based on the above observations are now described several circuit concepts, which allow reducing the collapse of the regulated supply voltage occurring at a load change (change of the supply current provided by the regulation transistor).

Figure 3:
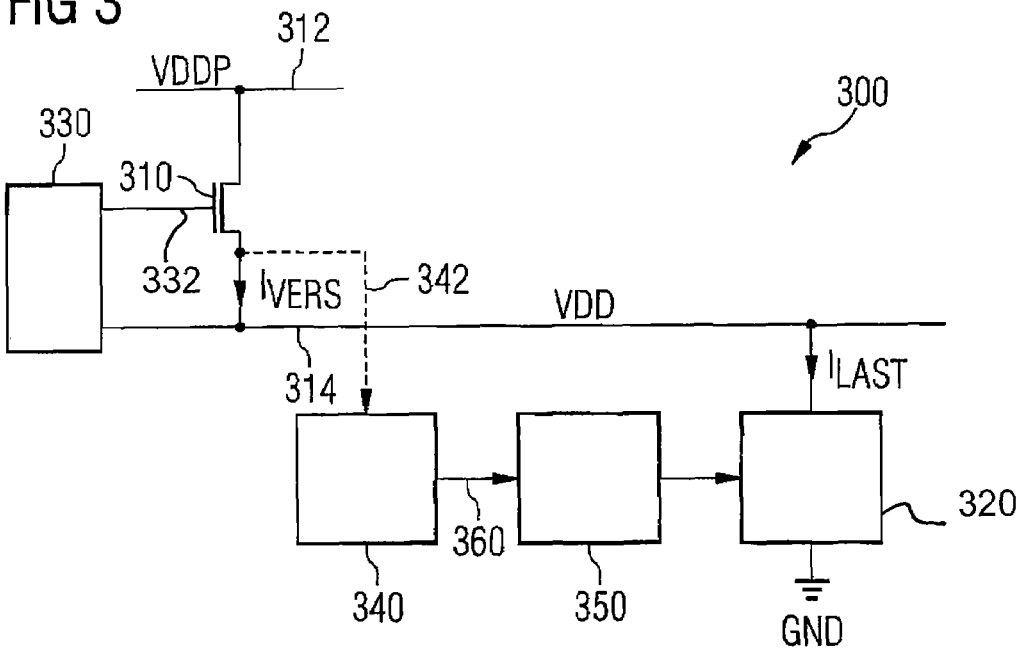
FIG. 3 shows a block diagram of a voltage-supply circuit of the invention according to a first exemplary embodiment of this invention.

FIG. 3 shows a block diagram of a voltage-supply circuit of the invention according to a first exemplary embodiment of this invention. The voltage-supply circuit of FIG. 3 is designated, in its whole, by 300. A regulation transistor 310, which is shown here e.g. as a MOS field-effect transistor, is connected between a first supply-voltage feed line 312 and a second supply-voltage feed line 314. The first supply-voltage feed line 312 is e.g. connected to an (external) voltage supply that provides a first supply voltage VDDP on the first supply-voltage feed line 312. The second supply-voltage feed line 314 is e.g. coupled to a load 320, so that a regulated supply voltage VDD is provided to the load 320 by the second supply-voltage feed line 314. To this end the regulation transistor 310 provides a supply current $I_{VERS}$ to the second supply-voltage feed line. The attention is drawn here furthermore to the fact that the regulated supply voltage VDD is hereafter also called second supply voltage. The switching arrangement 300 furthermore includes a regulation-transistor activation circuit 330, which is formed to activate a control terminal (gate terminal) 332 of the regulation transistor 310 based on the regulated second supply voltage VDD so that the second regulated supply voltage VDD adopts a predetermined value at least in a passive state. The predetermined value is chosen so that to the load 320 is provided with a voltage that allows a reliable operation of the load 320. Furthermore, e.g. all voltages are related to a reference potential GND. Furthermore, the attention is drawn on the fact that the regulation transistor 310 forms, together with the regulation-transistor activation circuit 330, a regulator or a voltage regulator.

The supply current $I_{VERS}$ provided by the regulation transistor 310 is substantially determined by the load current $I_{LAST}$ absorbed by the load 320. Thus, if the load current $I_{LAST}$ rises by a determined value, this is directly reflected by an increase of the supply current $I_{VERS}$ flowing through the regulation transistor 310.

The switching arrangement 300 includes furthermore operating-point determination circuit 340. The operating-point determination circuit 340 is formed to determine, based on information 342 that is a measure for the supply current $I_{VERS}$, whether the regulation transistor is at a low operating point.

The operating-point determination circuit generates e.g. an analogue signal that represents a measure for an amplitude of the operating point. Depending on the analogue signal, it can be decided, e.g. through a comparison with one or several threshold values, whether the regulation transistor is at a low operating point or at a high operating point, or also between the low operating point and the high operating point.

In other words, the operating-point determination circuit 340 evaluates a variable that permits a conclusion as to a supply current $I_{VERS}$ provided by the regulation transistor 310. For example, the operating-point determination circuit 340 can evaluate a current that is derived from the supply current $I_{VERS}$ or that is substantially proportional to the supply current $I_{VERS}$. It is generally assumed here that the operating-point determination circuit evaluates a variable that is statically related to the supply current $I_{VERS}$ flowing through the regulation transistor 310, which is thus an image of the current supply current $I_{VERS}$ (and is thus only insignificantly influenced by a background of the supply current).

A low operating point is defined by the fact that the regulation transistor at the low operating point is not capable of compensating an increase of the supply current caused (determined) by the load 320 so that the second supply voltage VDD does not fall at any time below a predetermined permissible minimum voltage value, below which a reliable operation of the circuit or load 320 provided with the second supply voltage VDD is not guaranteed. In other words, the operating-point determination circuit 340 detects, based on information that is a measure for the supply current $I_{VERS}$, when the regulation transistor 310 is at a low operating point at which a rise of the load current $I_{LAST}$ by a predetermined current amount within a predetermined period (thus a rise of the load current occurring abruptly or faster than the time constants of the regulator) would cause the second supply voltage VDD to fall below the predetermined permissible minimum voltage value, below which a reliable operation of the load 320 is no longer guaranteed.

Very generally, it can thus be noted that the operating-point determination circuit is formed to detect a low operating point of the regulation transistor 310 when the supply current $I_{VERS}$ provided by the regulation transistor 310 is smaller than a predetermined value. The predetermined value is chosen within the technically meaningful range, which is suitable for a detection of a defined low operating point as described above.

The switching arrangement 300 includes furthermore prevention circuit 350, which is formed to prevent, starting from the low operating point, a rise of the supply current by at least the predetermined current amount from occurring within the predetermined period. The prevention circuit 350 receives from the operating-point determination circuit 340 information 360 on whether a low operating point is present. To this end, the prevention circuit 350 acts on the circuit or load 320 provided with the second supply voltage VDD, the prevention circuit 350 exerting an influence on the load current $I_{LAST}$.

In other words, the prevention circuit 350 prevents the load current $I_{LAST}$ absorbed by the load 320 from rising fast or abruptly (within the predetermined period) by at least the predetermined current amount when the regulation transistor 310 is at a low operating point. A fast rise of the load current $I_{LAST}$ or a corresponding rise of the supply current $I_{VERS}$ by at least the predetermined current amount within the predetermined period would cause, according to the corresponding definition of the low operating point, the second supply voltage VDD to drop below the predetermined permissible minimum voltage value when the regulation transistor 310 is at a low operating point.

The switching arrangement 300 thus prevents the second supply voltage VDD from falling below the predetermined permissible minimum voltage values, so that a reliable operation of the circuit provided with the second supply voltage VDD is guaranteed at any time.

The switching arrangement 300 shown thus materialises the central thought at the basis of this invention of preventing "bad" load jumps when the voltage regulator is at a low operating point. By a "bad" load jump is understood a load jump that would result into a significant voltage drop, so that e.g. the second supply voltage VDD would fall below the predetermined permissible minimum voltage values, whereby a reliable operation of the load 320 fed by the second supply-voltage feed line would no longer be guaranteed.

Figure 4:
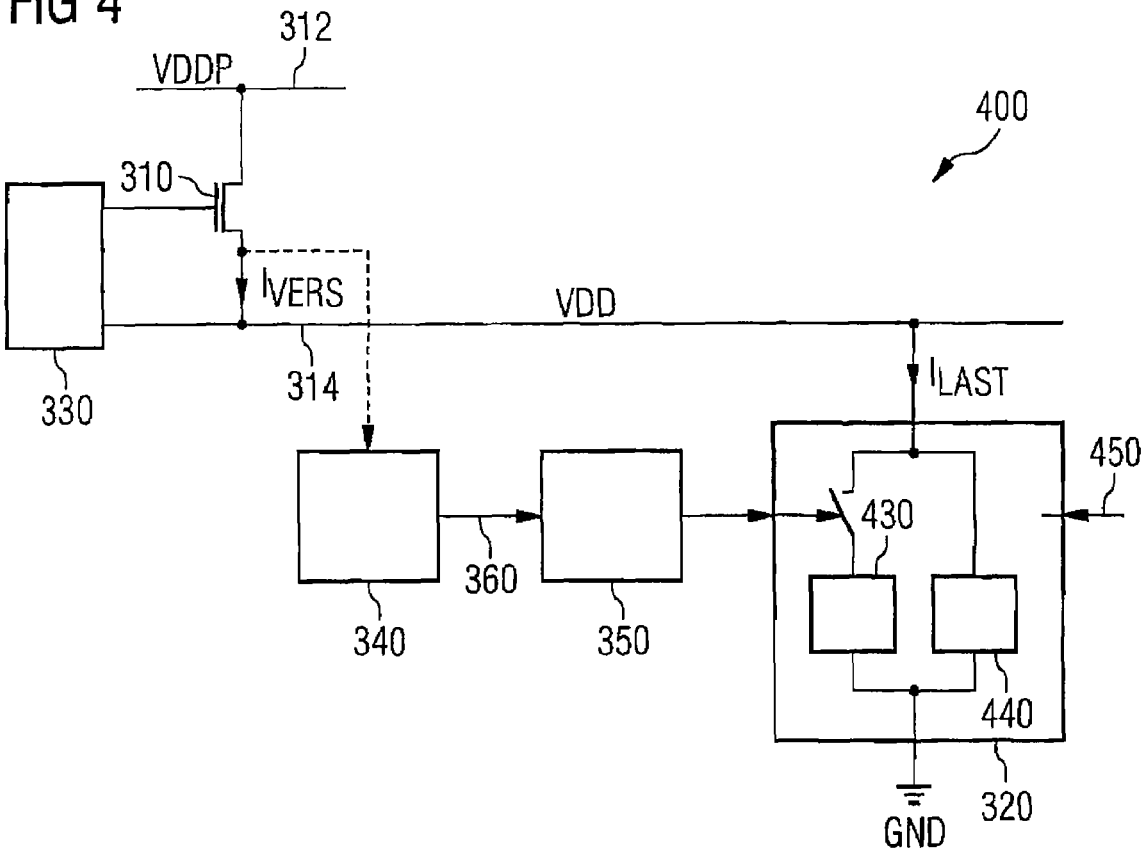
FIG. 4 shows a block diagram of a voltage-supply circuit of the invention according to a second exemplary embodiment of this invention.

FIG. 4 shows a block diagram of a voltage-supply circuit of the invention according to a second exemplary embodiment of this invention. The switching arrangement of FIG. 4 is designated, in its whole, by 400. The attention is drawn on the fact that the switching arrangement 400 is based on the switching arrangement 300. Therefore, identical means or variables are designated by identical reference numerals. A repetition of the corresponding description is therefore omitted and, instead, one should refer in this respect to the description of the voltage-supply circuit 300.

In the voltage-supply circuit 400, the prevention circuit 350 is formed to block at least an inactive circuit portion 430 of the load 320 provided with the second supply voltage VDD, provided the operating-point determination circuit 340 signals that the regulation transistor is at a low operating point. The prevention circuit 350 is furthermore formed to release the blocked circuit portion 430 for activation when the operating-point determination circuit 340 signals that the regulation transistor 310 is no longer at a low operating point.

In other words, the load 320 includes at least two circuit portions 430, 440, which are both inactive at a moment at which a low operating point of the regulation transistor 310 is detected, and thus have at most a small quiescent current consumption. The power consumption of both circuit portions 430, 440 contributes to the load current $I_{LAST}$. The load 320 receives furthermore e.g. a signalling signal 450 through which the load is requested to activate both circuit portions 430, 440. However, as long as the regulation transistor 310 is at a low operating point, the prevention circuit 350 blocks the activation of the first circuit portion, so that the first circuit portion 430 and the second circuit portion 440 cannot be activated simultaneously. Thus, in response to an activation of the signalling signal 450 only the second circuit portion is activated, however not the first circuit portion, when the regulation transistor is at a low operating point. If the regulation transistor is instead not at a low operating point, both circuit portions 430, 440 are however activated simultaneously (or within a period that is shorter than the time constant of the regulation) by the signalling signal 450.

Furthermore, the division of the load 320 into two circuit portions 430, 440 is advantageously chosen so that an activation of the second circuit portion 440 does not cause a collapse of the second supply voltage VDD below the permissible minimum voltage value, even when the regulation transistor 310 is at a low operating point. Furthermore, a simultaneous switching on of both circuit portions 430, 440 would typically cause a collapse of the second supply voltage VDD below the permissible minimum voltage value when the regulation transistor 310 is at a low operating point.

Generally speaking, the prevention circuit thus prevents the simultaneous activation of both circuit portions 430, 440 when the regulation transistor 310 is at a low operating point.

The prevention circuit 350 is furthermore formed to release the first circuit portion 430 for activation when the regulation transistor 310 is not or no longer at a low operating point. Thus, the prevention circuit 350 effectively causes both circuit portions 430, 440 to be activated, when a low operating point is present, not simultaneously, but successively, even when the activation signal 450 indicates that a simultaneous activation of both circuit portions 430, 440 is desired.

The prevention circuit 350 can e.g. be formed to interrupt a voltage supply of the first circuit portion 430 when the operating-point determination circuit 340 signals that the regulation transistor 310 is at a low operating point, and to allow the voltage supply to the first circuit portion 430 when the operating-point determination circuit 340 signals that the regulation transistor 310 is not or no longer at a low operating point.

Furthermore, the prevention circuit 350 can, alternatively or additionally, be formed to block an activation of the first circuit portion 430 in that the prevention circuit 350 interrupts or de-activates a clock pulse supply to the first circuit portion 430.

In addition, the prevention circuit 350 can, alternatively or additionally, be formed to block the first circuit portion 430 by interrupting data or control signals that serve as input signals for the first circuit portion 430.

Furthermore, the prevention circuit 350 can, alternatively or additionally, be formed to activate both circuit portions 430, 440 successively in time, with a predetermined delay, when the operating-point determination circuit 340 signals that the regulation transistor 310 is at a low operating point, and when, in addition, an activation of the circuit portions 430, 440 is requested e.g. by means of an activation signal 450.

In other words, the prevention circuit can either be formed to activate the first circuit portion 430 with a predetermined delay after an activation of the first circuit portion 440 when the necessity of such activation is indicated by means of a control signal, and when the regulation transistor is at a low operating point. Alternatively, the prevention circuit 350 can be formed to generally allow an activation of the first circuit portion 430 only when the operating-point determination circuit 340 signals that the regulation transistor 310 is not or no longer at a low operating point. Thus, when the operating-point determination circuit 340 signals that the regulation transistor is not at a low operating point, the prevention circuit 350 advantageously allows any activation of the first circuit portion.

The switching arrangement 400 thus guarantees that both circuit portions 430, 440 are not activated simultaneously when the regulation transistor 310 is at a low operating point. In this way, an inadmissibly high abrupt rise of the load current $I_{LAST}$ or the supply current $I_{VERS}$ is prevented, whereby it is guaranteed, here too, that the second supply voltage VDD does not fall below the permissible minimum voltage value.

Figure 5:
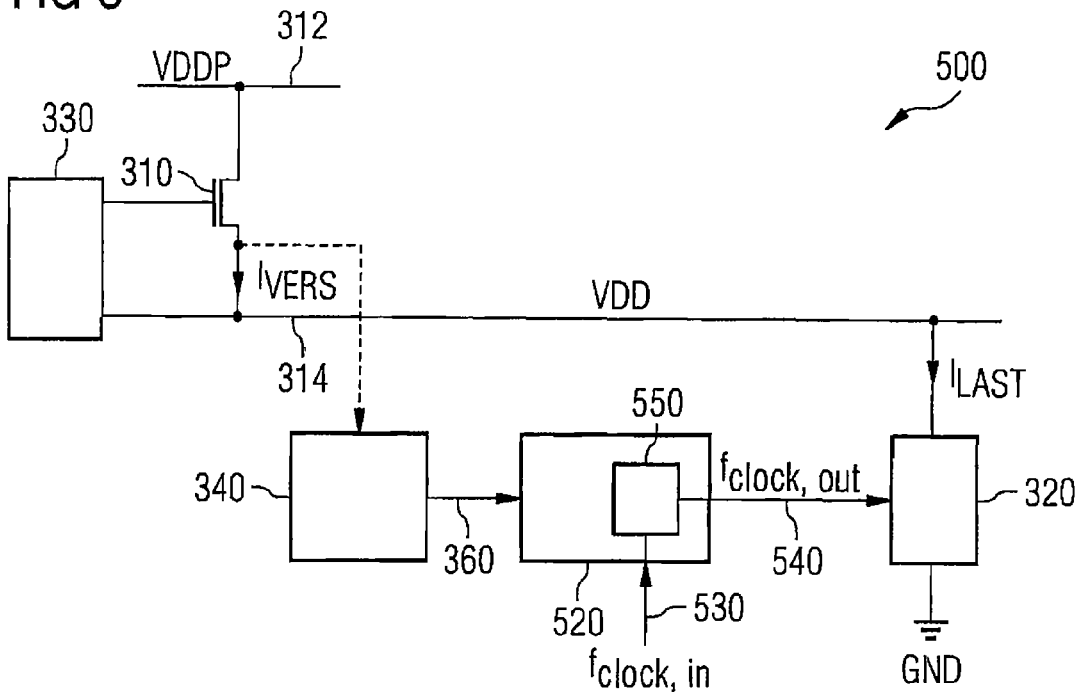
FIG. 5 shows a block diagram of a voltage-supply circuit of the invention according to a third exemplary embodiment of this invention.

FIG. 5 shows a block diagram of a voltage-supply circuit of the invention according to a third exemplary embodiment of this invention. The voltage-supply circuit shown in FIG. 5 is designated, in its whole, by 500. Since the voltage-supply circuit 500 is similar to the voltage-supply circuits 300, 400 described with reference to FIGS. 3 and 4, corresponding means or variables of the voltage-supply circuit 500 are designated here by identical reference numerals as in the switching arrangements 300 and 400. Therefore, in this connection, one should refer to the description of the switching arrangements 300 and 400.

In the voltage-supply circuit 500, prevention circuit 520 receives from the operating-point determination circuit 340 the information 360, which indicates whether the regulation transistor 310 is at a low operating point or not. The prevention circuit 520 receives, furthermore, a clock input signal 530 (designated by $f_{clockin}$) and provides a clock output signal 540 (designated by $_{clockout}$) to the load 320. The prevention circuit 520 includes furthermore clock-frequency adjusting circuit 550, which is formed to set, based on the clock input signal 530 at a predetermined frequency of the clock input signal 530, a frequency of the clock output signal 540 to at least two predetermined values. The setting of the frequency of the clock output signal 540 occurs as a function of the information 360 as to whether the regulation transistor 310 is at a low operating point or not.

The prevention circuit 520 is formed to set the frequency of the clock output signal to a low value when the operating-point determination circuit 340 signals that the regulation transistor 310 is at a low operating point. Furthermore, the prevention circuit 520 is formed to set the frequency of the clock output signal 540 to a high value in another case.

It is assumed here that the power consumption of the load 320 depends on the frequency of the clock output signal 540 provided to the load. Thus, if a switching arrangement contained in the load 320 is activated, power consumption $I_{LAST}$ of the load 320 rises only by a small amount when the frequency of the clock output signal 540 has the low value. The power consumption $I_{LAST}$ of the load 320 rises, instead, by a large amount when the frequency of the clock output signal 540 has the high value.

Thus, through the voltage-supply circuit 500 can be achieved altogether that at an activation of the load the current absorbed by the load $I_{LAST}$ rises only by a small value when the regulation transistor is at the low operating point, while, on the other hand, the power consumption $I_{LAST}$ of the load 320 exhibits, at an activation, a larger increase when the regulation transistor 310 is not at a low operating point.

If the operating-point determination circuit 340 detects that the regulation transistor 310 is no longer at a low operating point, the prevention circuit 520 can, furthermore, increase the clock frequency of the clock output signal 540. It is thus achieved that the power consumption $I_{LAST}$ of the load 320 is stepwise increased when the regulation transistor 310 is originally at a low operating point.

In brief, it can thus be noted that the voltage-supply circuits 400, 500 allow, according to a central thought of this invention, performing stepwise, depending on the operating point of the voltage regulator (comprised of the regulation transistor 310 and the regulation-transistor activation circuit 330), large load jumps (thus quick changes of the load current $I_{LAST}$ or of the corresponding supply current $I_{VERS}$), in order to thereby relieve the voltage regulator. If the regulator (or the operating-point determination circuit 340) signals a low operating point, the prevention circuit 520 reduces the clock frequency or working frequency of determined system modules. Thus, the load change is attenuated.

Furthermore, e.g. the accesses to a non-volatile memory (NVM=non-volatile memory) can occur with only part (for example half) of the total available read amplifiers when a low operating point of the regulator is present. In this case, the first circuit portion 430 in the switching arrangement 400 corresponds to twenty read amplifiers for accessing a non-volatile memory, while the second circuit portion 440 corresponds to twenty further read amplifiers for accessing to the non-volatile memory.

If the regulator pulled up its operating point, i.e. if a low operating point is no longer signalled (by the operating-point determination circuit 340), it is again possible to switch to full power (performance). The switching to full power corresponds to an increase of the clock frequency of a component contained in the load 320 or activating additional circuit portions (e.g. read amplifiers). The switching to the full capacity can occur exclusively based on a determined operating point of the regulator or, alternatively, after elapsing of a determined delay following an activation of a circuit portion contained in the load.

The current-supply circuits 400, 500 described with reference to FIGS. 4 and 5 are thus based on the observation that e.g. a larger current jump causes a larger voltage collapse of the second supply voltage VDD than a smaller current jump (cf. FIG. 2). By jump is understood a fast change of the current within a period that is shorter than a time constant of the voltage regulation including the regulation transistor. The voltage-supply circuits 400, 500 thus generally result into reducing the amount of a load jump (thus the amount of a change occurring within the predetermined period or increase of the load current $I_{LAST}$ absorbed by the load) with respect to conventional switching arrangements.

Figure 6:
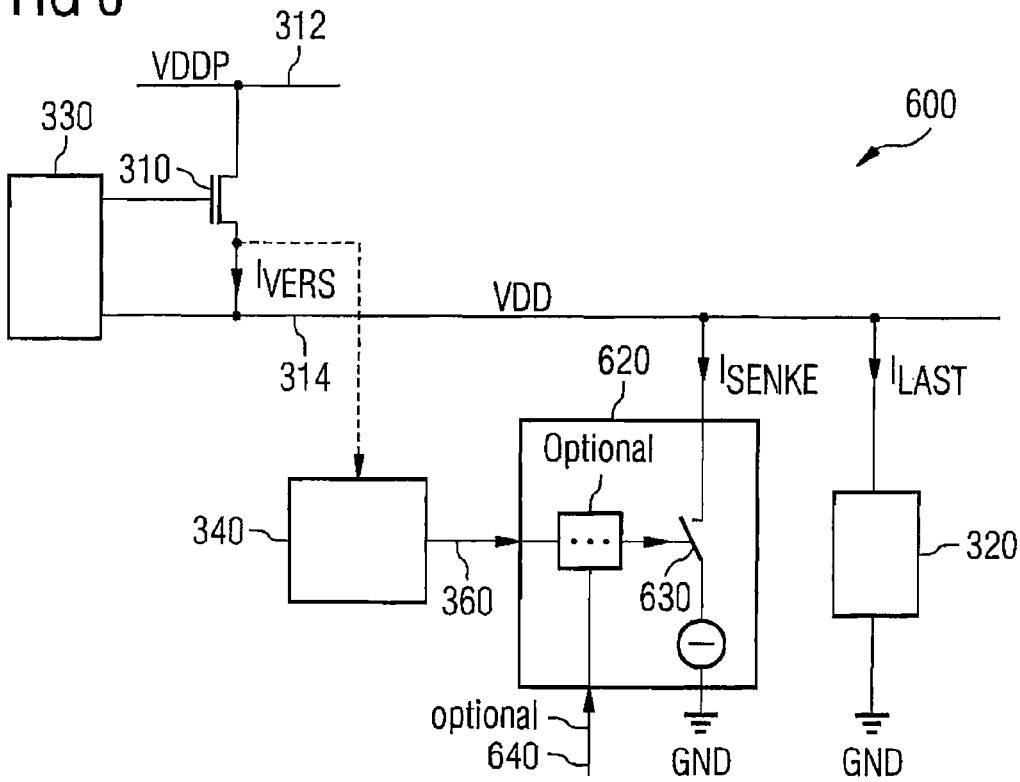
FIG. 6 shows a block diagram of a voltage-supply circuit of the invention according to a fourth exemplary embodiment of this invention.

FIG. 6 shows a block diagram of a voltage-supply circuit of the invention according to a fourth exemplary embodiment of this invention. The voltage-supply circuit of FIG. 6 is designated, in its whole, by 600. Elements and variables of the voltage-supply circuit 600 that, because of their meaning or function are already known from the voltage-supply circuits 300, 400, 500 of FIGS. 3, 4 and 5 are designated in the voltage-supply circuit 600 by identical reference numerals and are not described again here. Instead, one should refer to the description of the voltage-supply circuits 300, 400, 500.

In the voltage-supply circuit 600 prevention circuit 620 includes a switchable current sink 630. The prevention circuit 620 is formed to switch on or off the switchable current sink 630 depending on the information 360 on whether the regulation transistor 310 is at a low operating point. The switchable current sink 630 is furthermore coupled to the second supply-voltage feed line 314 and is formed to derive, in a switched-on state, a sink current $I_{SENKE}$ from the second supply-voltage feed line 314. Thus, the supply current $I_{VERS}$ flowing through the regulation transistor 210 increases when the switchable current sink 630 is switched on.

The current $I_{SENKE}$ of the sink is advantageously so dimensioned that the regulation transistor 310 abandons the low operating point when the switchable current sink 630 is switched on.

Thus, the switchable current sink 630 prevents the regulation transistor 310 from being at a low operating point for an extended time interval. Thus, the change of the power consumption $I_{LAST}$ of the load 320 cannot cause the second supply voltage to collapse to such an extent as to fall below the permissible minimum voltage value.

Optionally, the prevention circuit 620 is formed, furthermore, to receive a signalling signal 640 indicating that there is approaching an increase of the power consumption $I_{LAST}$ of the load 320 that is so significant that, because of the load increase, the second supply voltage VDD could collapse in an inadmissible way when the regulation transistor 310 is at a low operating point. In this case the prevention circuit 620 is advantageously formed to activate the switchable current sink 630 only when the signalling signal 640 indicates the approaching of such a strong load change and, furthermore, the operating-point determination circuit 340 simultaneously signals that the regulation transistor 310 is at a low operating point. Thus, the presence of a low operating point of the regulation transistor 310 does not lead in all cases to an activation of the switchable current sink 630, but only when a large change of the power consumption $I_{LAST}$ of the load 320 is actually approaching.

The signalling signal 640 can be generated e.g. by the load 320 itself or by a higher control means, which activates the load 320. For example, the signalling signal 640 can, in response to an observation that an activation of a circuit portion of the load 320 is approaching, be activated by the load 320 itself or by the higher control means (for example a sequential control).

The voltage-supply circuit 600 thus performs the observation according to invention that it is advantageous to bring, through a freely programmable current sink (the switchable current sink 630), if necessary the voltage regulator (comprised of the regulation transistor 310 and the regulation-transistor control circuit 330) to an operating point, so that a forthcoming "bad" load change can be withstood without a significant voltage collapse of the second supply voltage VDD. The design according to invention provides for comparing an actual current consumption $I_{VERS}$ of the chip with a freely adjustable reference current and absorb, when the current consumption of the system is too small, additional current $I_{SENKE}$ through the current sink 630. Thus, a minimum system current is ensured, whereby the voltage regulator is held at an operating point, so that the voltage supply for the system is also guaranteed at the typically occurring load change of the derivative or the load 320. If large load changes are approaching, the base current of the system (thus the supply current $I_{VERS}$) is raised before same are triggered (e.g. before an activation of a cryptographic processor on a chip card). The regulator is thus brought to a higher operating point.

The voltage-supply circuit according to invention 600 is thus based on the observation that e.g. a current jump starting from a low initial current value causes a substantially higher voltage collapse than a current jump of about the same absolute amplitude starting from a higher initial current value (cf. FIGS. 1*a* and 1*b*).

It is to be noted that, based on said observation, the simplest solution consists in raising only the base current of the system (thus the supply current $I_{VERS}$, which is present when the load 320 absorbs a minimum current $I_{LAST}$) so that no excessive collapse of the second supply voltage VDD does occur, even at a worst-case load jump.

A highest possible load jump of a system is usually caused by the "worst" component of the system, thus by a component that can be activated and de-activated and that has (compared to the other components) a high power consumption. Thus, e.g. in different types of chip cards different components can have the largest power consumption. In a derivative, e.g. a cryptographic co-processor (e.g. of the type Crypto2000) is the determining factor (thus the component the power consumption of which varies most). In another derivative, these are e.g. the read amplifiers of the non-volatile memory (NVMs). In other words, the determining part for the load changes or the change in power consumption depends on the components a derivative is comprised of.

In a simple embodiment of this invention the base current of the system is raised by a current sink so that even the highest possible load change does not result into an excessive voltage collapse. In other words, with a constant power source a current can be derived from the second supply-voltage feed line, whereby the supply current provided by the regulation transistor is so increased that the regulation transistor is at a high operating point at which the regulation transistor or the regulation is capable of compensating the regulated second supply voltage so that the second supply voltage does not fall below the permissible minimum voltage, even at the highest possible load change caused by the load.

In the described very simple embodiment, however, an unnecessarily high base current flows at all other load changes (thus load changes that are smaller than the worst-case load change).

It is therefore better to raise the base current only when a bad load change is imminent. It is e.g. enough to moderately raise the base current of the system (e.g. by activating a current sink that is coupled to the second supply-voltage feed line) only short before the activation of the cryptographic processor. In other words, the base current should advantageously be raised before a circuit portion of the load the activation of which results into a highest possible load change is activated. A forthcoming activation of such a component can be signalled e.g. to the prevention circuit according to invention by the load itself or by a higher control means (sequential control). The raising of the base current then prepares the voltage regulator (including the regulation transistor 310) for the forthcoming high load jump (e.g. the switching on of the cryptographic processor).

According to another aspect, the voltage-supply circuit includes, furthermore, a switchable current sink, which is coupled to the second supply-voltage feed line so that a total current consumption of a system coupled to the second supply-voltage feed line can be adjusted by activating the switchable current sink. In this case, the operating-point determination circuit is coupled to the switchable current sink and is formed to activate the controllable current sink in order to set a constant total current absorption.

Figure 7:
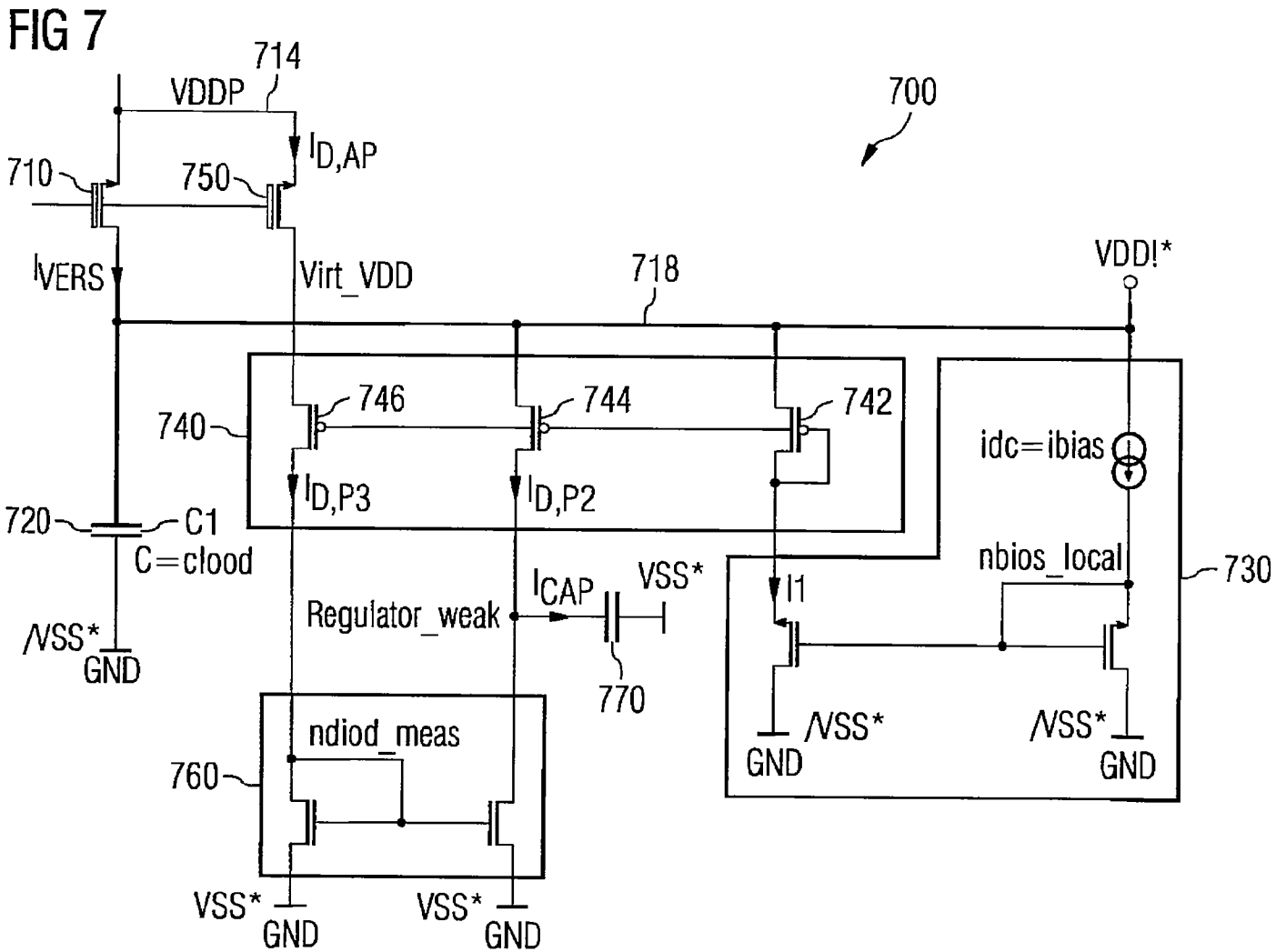
FIG. 7 shows a circuit diagram of a switching arrangement for signalling a low operating point for use in a voltage-supply circuit according to invention.

FIG. 7 shows a circuit diagram of a switching arrangement according to invention for signalling a low operating point for use in a voltage-supply circuit according to invention. The switching arrangement of FIG. 7 is designated, in its whole, by 700. A regulation transistor 710 is connected between the first supply-voltage feed line 714 and a second internal supply-voltage feed line 718. In the regulation transistor 710, it is a NMOS field-effect transistor the drain terminal of which is connected to the first supply-voltage feed line 714, and the source terminal of which is coupled to the second supply-voltage feed line 718. Between the second supply-voltage feed line 718 and a reference potential GND is connected a capacitor 720.

The switching arrangement 700 includes, furthermore, a power-source circuit 730, which is fed by the second supply-potential feed line 718. The power-source circuit 730 provides a predetermined constant current $I_1$. In another embodiment, the current $I_1$ can however also be adjusted variably, as will be described below.

The constant current $I_1$ feeds an arrangement 740 of transistors, which are interconnected similarly to a current bank. The arrangement 740 includes a first PMOS field-effect transistor 742 the gate terminal and drain terminal of which are coupled to each other and, furthermore, to an output of the power-source circuit 730. A source terminal of the first PMOS field-effect transistor 742 is, furthermore, coupled to the second supply-voltage feed line 718. Through the drain-source path of the first PMOS field-effect transistor 742 thus flows the constant current $I_1$ provided by the power-source circuit 730, a gate-source voltage of the first PMOS field-effect transistor 742 being adjusted to allow the corresponding current flow.

Furthermore, the gate terminal of the first PMOS field-effect transistor 742 is coupled to a gate terminal of a second PMOS field-effect transistor 744 and to a gate terminal of a third PMOS field-effect transistor 746. A source terminal of the second PMOS field-effect transistor 744 is, furthermore, coupled to the second supply-voltage feed line 718, so that a gate-source voltage of the second PMOS field-effect transistor is 744 equal to a gate-source voltage of the first PMOS field-effect transistor 742. The second PMOS field-effect transistor 744 thus provides, at its drain terminal, a current that, depending on a relation between the channel widths of the first PMOS field-effect transistor 742 and the second PMOS field-effect transistor 744, is proportional to a drain current of the first PMOS field-effect transistor 742 and, therefore, proportional to the constant current $I_1$ provided by the power-source circuit 730.

The switching arrangement 700 includes, furthermore, an operating-point determination transistor 750, which is structured similarly to the regulation transistor 710. In other words, a structure of the operating-point determination transistor 750 is similar to a structure of the regulation transistor 710, e.g. as regards to doping profiles, technology used, channel length and layer thicknesses. The operating-point determination transistor 750 thus differs from the regulation transistor 710 essentially in that, because of a change of a geometrical variable, the operating-point determination transistor (assuming identical voltages present at the regulation transistor and the operating-point determination transistor) provides a current, which is proportional to the current provided by the regulation transistor. In this exemplary embodiment, the operating-point determination transistor 750 is e.g. a NMOS field-effect transistor, which differs from the regulation transistor only in that the channel width of the operating-point determination transistor 750 is a fraction of the channel width of the regulation transistor 710. For example, the channel width of the operating-point determination transistor can be between one tenth and one ten thousandth of the channel width of the regulation transistor.

The gate terminals of the regulation transistor 710 and the operating-point determination transistor 750 are advantageously both activated by a regulation circuit, which, based on the voltage on the second supply-voltage feed line 718, generates an activation signal for said transistors mentioned, in order to compensate the voltage on the second supply-voltage feed line 718 to a predetermined value.

A drain terminal of the operating-point determination transistor 750 is coupled to a drain terminal of the regulation transistor 710. Furthermore, the gate terminals of the regulation transistor 710 and the operating-point determination transistor 750 are coupled to each other. A source terminal of the operating-point determination transistor 750 is, furthermore, coupled to a source terminal of the third PMOS field-effect transistor 746.

A drain terminal of the third PMOS field-effect transistor 746 is, furthermore, operatively coupled, through a current mirror 760 that is e.g. comprised of two NMOS field-effect transistors, to the drain terminal of the second PMOS field-effect transistor 744.

Furthermore, a second capacitor 770 is coupled to the drain terminal of the second PMOS field-effect transistor 744. The capacitor 770 is thus charged with a current $I_{CAP}$ that, except for a possible scaling, is equal to a difference between the drain current of the second PMOS field-effect transistor 744 and the third PMOS field-effect transistor 746. In other words, $$I_{CAP}=c_1\times I_{D,P2}-c_2\times I_{D,P3},$$

where $I_{D,P2}$ is the drain current of the second PMOS field-effect transistor 744, where $I_{D,P3}$ is the drain current of the third PMOS field-effect transistor 746, and where $c_1$ and $c_2$ are constant scaling factors.

The drain current $I_{D,P3}$ of the third PMOS field-effect transistor 746 substantially depends on a difference of potential between the gate potential of the operating-point determination transistor 750 and the gate potential of the third PMOS field-effect transistor 746. The corresponding difference of potential is furthermore also a measure for the gate-source difference of potential of the regulation transistor 710 and thus for the supply current $I_{VERS}$ flowing through the regulation transistor 710.

How the drain current $I_{D,\,P3}$ of the third PMOS field-effect transistor 746 is adjusted will now be described. First of all, it is assumed that the drain current $I_{D,\,AP}$ of the operating-point determination transistor 750 adopts an equilibrium value $I_{D,\,AP,\,0}$ when at the source terminal of the operating-point determination transistor 750 is present a potential that is equal to the potential VDD present on the second supply-voltage feed line 718. In said case, thus when the potential at the source terminal of the third PMOS field-effect transistor 746 is also equal to VDD, the drain current $I_{D,\,P3}$ of the third PMOS field-effect transistor 746 adopts, furthermore, an equilibrium value $I_{D,\,P3,0}$. Furthermore, the attention is drawn to the fact that thanks to an identical execution of the operating-point determination transistor 750 and the regulation transistor 710 (except for a channel width or, in the case of a bipolar transistor, for an emitter surface) the equilibrium value $I_{D,\,AP,\,0}$ is proportional to the supply current $I_{VERS}$ provided by the regulation transistor 710.

In the event the equilibrium current $I_{D,\,AP,\,0}$ of the operating-point determination transistor 750 is larger than the operating-point current $I_{D,\,P3,\,0}$ of the third PMOS field-effect transistor 746, the common source potential of the operating-point determination transistor 750 and the third PMOS field-effect transistor 746 is adjusted so that the actual drain current $I_{D,\,P}$ of the third PMOS field-effect transistor 746 is comprised between the equilibrium values $I_{D,AP,0}$ and $I_{D,P3,0}$. On the other hand, if the equilibrium current of the operating-point determination transistor 750 is smaller than the equilibrium current of the third PMOS field-effect transistor 756, the actual drain current of the third PMOS field-effect transistor 746 is also comprised between the equilibrium current $I_{D,\,AP,\,0}$ and $I_{D,\,P3,\,0}$.

It should thus be noted that the drain current of the third PMOS field-effect transistor 746 exhibits a monotonous dependence on the equilibrium current $I_{D,\,AP,\,0}$, thus also on the supply current $I_{VERS}$. Therefore, the drain current $I_{D,\,P3}$ of the third PMOS field-effect transistor 746 is a measure for the supply current $I_{VERS}$ flowing through the regulation transistor 710, thanks to which an (instantaneous) conclusion as to the current supply current $I_{VERS}$ is possible.

The operation of the switching arrangement 700 shown can be summarized as follows:

The second capacitor 770 is charged or discharged with a current $I_{CAP}$ the amplitude of which instantaneously depends on a predetermined current (the drain current $I_{D,\,P2}$ of the second PMOS field-effect transistor 744) and furthermore on the supply current $I_{VERS}$ provided by the regulation transistor 710. In other words, the charging current $I_{CAP}$ of the second capacitor 770 depends on an instantaneous value of the supply current $I_{VERS}$. If the momentary supply current $I_{VERS}$ is e.g. larger in amount than a predetermined value, the second capacitor 770 is discharged until the second capacitor 770 has a minimum capacitor voltage. On the other hand, the second capacitor 770 is charged when the supply current $I_{VERS}$ is smaller than a predetermined current value, provided that the tension at the second capacitor 770 has not reached a maximum possible value. Very generally, it can thus be formulated that the charge stored on the second capacitor 770 changes according to a first direction when the supply current $I_{VERS}$ is higher than the predetermined threshold-current value, and that the charge on the second capacitor 770 changes according to a second direction opposite the first direction when the supply current $I_{VERS}$ is smaller than the predetermined threshold-current value. The speed at which the second capacitor 770 is charged or discharged depends on the amplitude of a difference in amount between the supply current $I_{VERS}$ and the threshold-current value.

The voltage of the second capacitor 770 can furthermore be used as a measure for whether the regulation transistor 710 is at a low operating point or not. It is assumed that the regulation transistor 710 is at a low operating point when the supply current $I_{VERS}$ is smaller than the predetermined threshold-current value, and that the regulation transistor 710 is at a high operating point when the supply current $I_{VERS}$ is higher than the predetermined threshold-current value. A time period the regulation transistor 710 necessitated for a transition between a low operating point and a high operating point is reproduced by the second capacitor 770. The larger the difference in amount between the supply current $I_{VERS}$ and the threshold-current value, the faster a re-charging of the second capacitor 770 occurs, a voltage present through the second capacitor 770 being used as an indicator for signalling the operating point of the regulation transistor 710.

Furthermore, the attention is drawn on the fact that, in the switching arrangement 700 shown, the power source 730 must not necessarily provide a constant current $I_1$. It is instead possible that the current $I_1$ provided by the power source 730 varies according to whether the regulation transistor 710 is at a low operating point or at a high operating point. Thus, for example a hysteresis can be implemented, as will be described below. Furthermore, the power source 730 can be formed to receive information on whether a load change is approaching or is expected in the case of a load coupled to the second supply-voltage feed line 718. Accordingly, the power source 730 can be switched on or off or be switched between two different current values. This makes sense, since the decision on whether the regulation transistor 710 is at a low operating point or a high operating point substantially depends on the magnitude of the load change to be compensated by the regulation transistor. Thus, the condition for the detection of a low operating point or a high operating point can be adjusted as a function of the forthcoming load change. Furthermore, the power-source circuit 730 can also receive information on an amplitude of a forthcoming load change and thus adjust the current $I_1$ provided not only in two steps, but quantitatively as a function of the amplitude of the forthcoming load change. The power-source circuit 730 can receive the information about the magnitude of the forthcoming load change in the form of a discrete value or continuous value and adjust the current $I_1$ provided in the form of a discrete value or continuous value.

Furthermore, it should be noted that the switching arrangement shown in FIG. 7 (as well as all other exemplary embodiments described within the framework of this description) can be implemented in a way complementary to the switching arrangement 700 shown. In other words, circuit elements can be replaced by complementary circuit elements, the polarity of the supply voltage changing accordingly. For example, in a complementary embodiment NMOS field-effect transistors are replaced by PMOS field-effect transistors, and vice-versa. Furthermore, the embodiment with field-effect transistors shown is to be considered only as an example. An embodiment with bipolar transistors or a mixed embodiment with field-effect transistors and bipolar transistors is possible as well. When using bipolar transistors, the base terminal corresponds to the gate terminal of a field-effect transistor, the emitter terminal to a source terminal of the corresponding field-effect transistor and the collector terminal to the drain terminal of the corresponding field-effect transistor. NMOS field-effect transistors are typically replaced by NPN bipolar transistors, and PMOS field-effect transistors are typically replaced by PNP bipolar transistors.

In brief, it can thus be noted that with reference to FIG. 7 has been described a switching arrangement 700 that allows an implementation in principle of a circuit for signalling a low operating point of the regulation transistor 710. An actual current consumption of the chip provided with current by the second internal supply-voltage feed line 718 is compared to a (freely) adjustable reference current. In the case of too small a current consumption of the system, which can be noticed because of a low supply current $I_{VERS}$, a low operating point of the regulator is signalled to a global system.

Figure 8:
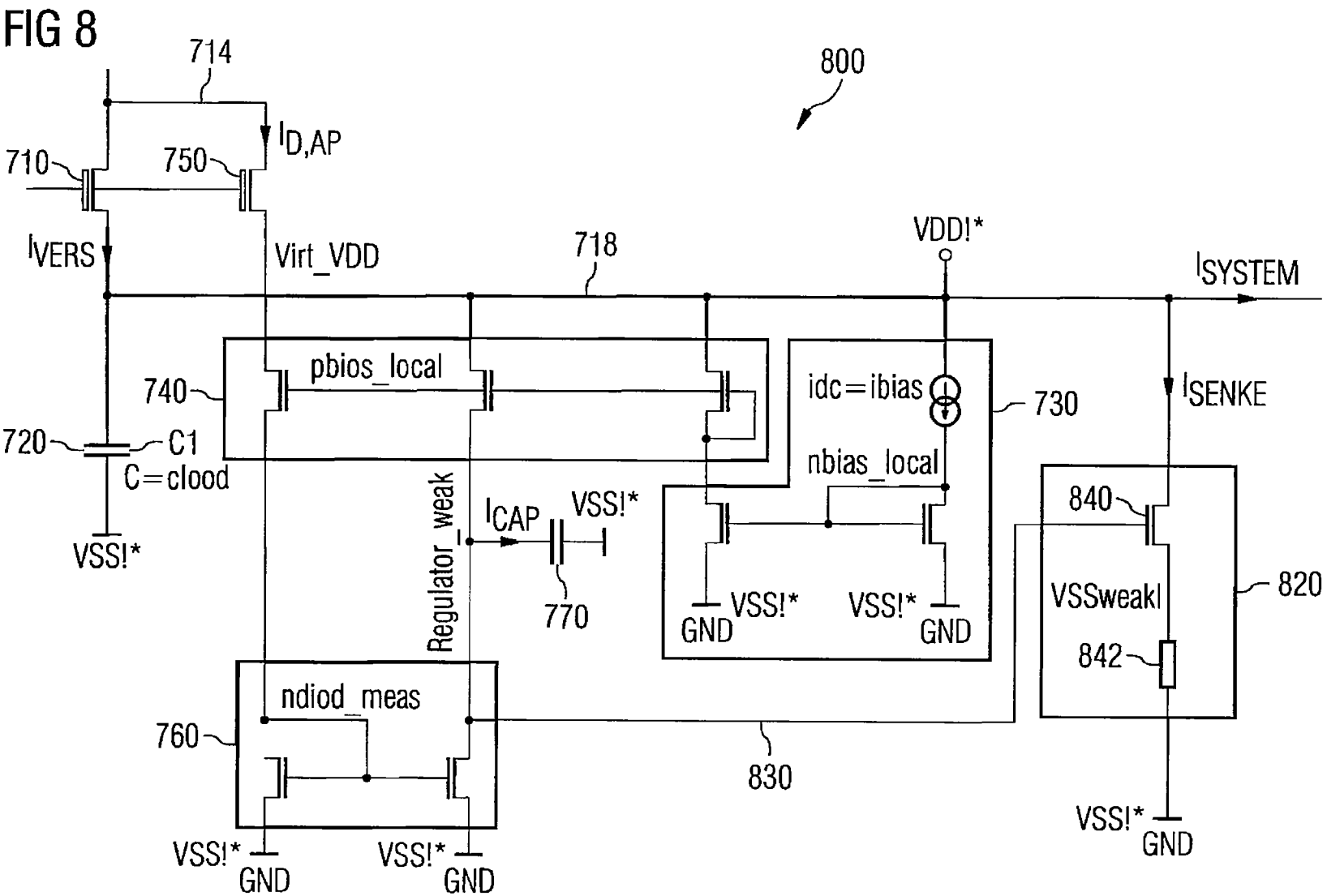
FIG. 8 shows a circuit diagram of a switching arrangement for creating a voltage-supply circuit according to the fourth exemplary embodiment of this invention using a programmable current sink.

FIG. 8 shows a circuit diagram of a switching arrangement for carrying out a voltage-supply circuit according to the fourth exemplary embodiment of this invention using a programmable current sink. The switching arrangement of FIG. 8 is designated, in its whole, by 800. The switching arrangement 800 corresponds in substantial parts to the switching arrangement 700 described with reference to FIG. 7. Therefore, identical means or variables are designated by identical reference numerals and are not described anew here. Instead, one will refer in this respect to the embodiments regarding the switching arrangement 700.

The switching arrangement 800 includes, besides the components already described as regards the switching arrangement 700, a switchable current sink 820. The switchable current sink 820 is connected between the second supply-voltage feed line 718 and the reference potential GND, and is formed to derive, as a function of a control voltage 830, a current $I_{SENKE}$ from the second supply-voltage feed line 718, whereby the current $I_{VERS}$ flowing through the regulation transistor 710 can be changed as a function of the current $I_{SENKE}$ of the switchable current sink 820.

Generally, it should be noted in this respect that the switching arrangement 800 is formed so that the current sink 820 derives a current $I_{SENKE}$ (for example towards the reference potential GND) when the current $I_{VERS}$ flowing through the regulation transistor 710 is lower than a predetermined threshold-current value. If the supply current $I_{VERS}$ flowing through the regulation transistor 710 is however higher than the predetermined threshold-current value, the switchable current sink 820 provides instead a low current or only an infinitesimal current.

The adjusting or switching characteristic of the switchable current sink 820 can be structured in different ways. Thus, the programmable current sink 820 can e.g. be formed to be switched substantially between two states, in which the switchable current sink 820 provides different current values $I_{SENKE1,2}$. On the other hand, it is however also possible that the current $I_{SENKE}$ provided by the switchable current sink 820 has, at least in a limited adjusting range, an approximately linear dependence on the supply current $I_{VERS}$, so that the current $I_{SENKE}$ is the larger as the supply current $I_{VERS}$ is smaller. Furthermore, it is alternatively preferred, in another exemplary embodiment, that the current $I_{SENKE}$ provided by the switchable current sink 820 has, at least in a limited working range, an approximately linear relation to a voltage present at the second capacitor 770.

In the switching arrangement 800 shown with reference to FIG. 8, the switchable current sink 820 includes a serial circuit comprised of an NMOS field-effect transistor 840 and a resistor 842. A drain terminal of the NMOS field-effect transistor 840 is coupled to the second supply-voltage feed line 718. Furthermore, a source terminal of the NMOS field-effect transistor 840 is coupled, through the resistor 842, to the reference potential GND, so that the resistor 842 acts as source counter-coupling. A gate terminal of the NMOS field-effect transistor 840 is furthermore coupled to a terminal of the second capacitor 770. Thus, at the gate terminal of the NMOS field-effect transistor 840*a* is present a voltage, which is a function of the voltage present at the second capacitor 770.

Thus, if the supply current $I_{VERS}$ is higher than the predetermined threshold-current value, the voltage at the source of the NMOS field-effect transistor 840 is reduced, whereby the current $I_{SENKE}$ decreases. The speed of the change is determined by the size of the second capacitor 770. On the other hand, if the supply current $I_{VERS}$ is smaller than the predetermined threshold-current value, the voltage at the gate terminal of the NMOS field-effect transistor 48 increases, whereby the current $I_{SENKE}$ evacuated by the switchable current sink 820 increases.

The switching arrangement 800 can thus very generally also be conceived as a current-regulation circuit, through which the supply current $I_{VERS}$ flowing through the regulation transistor 710, except for a regulation difference, is adjusted to a predetermined set value. Here, the switchable current sink 820 serves as an adjusting member.

In brief, it can thus be noted that the switching arrangement 800 according to FIG. 8 shows the implementation in principle of the programmable current sink in the voltage regulator.

Figure 9:
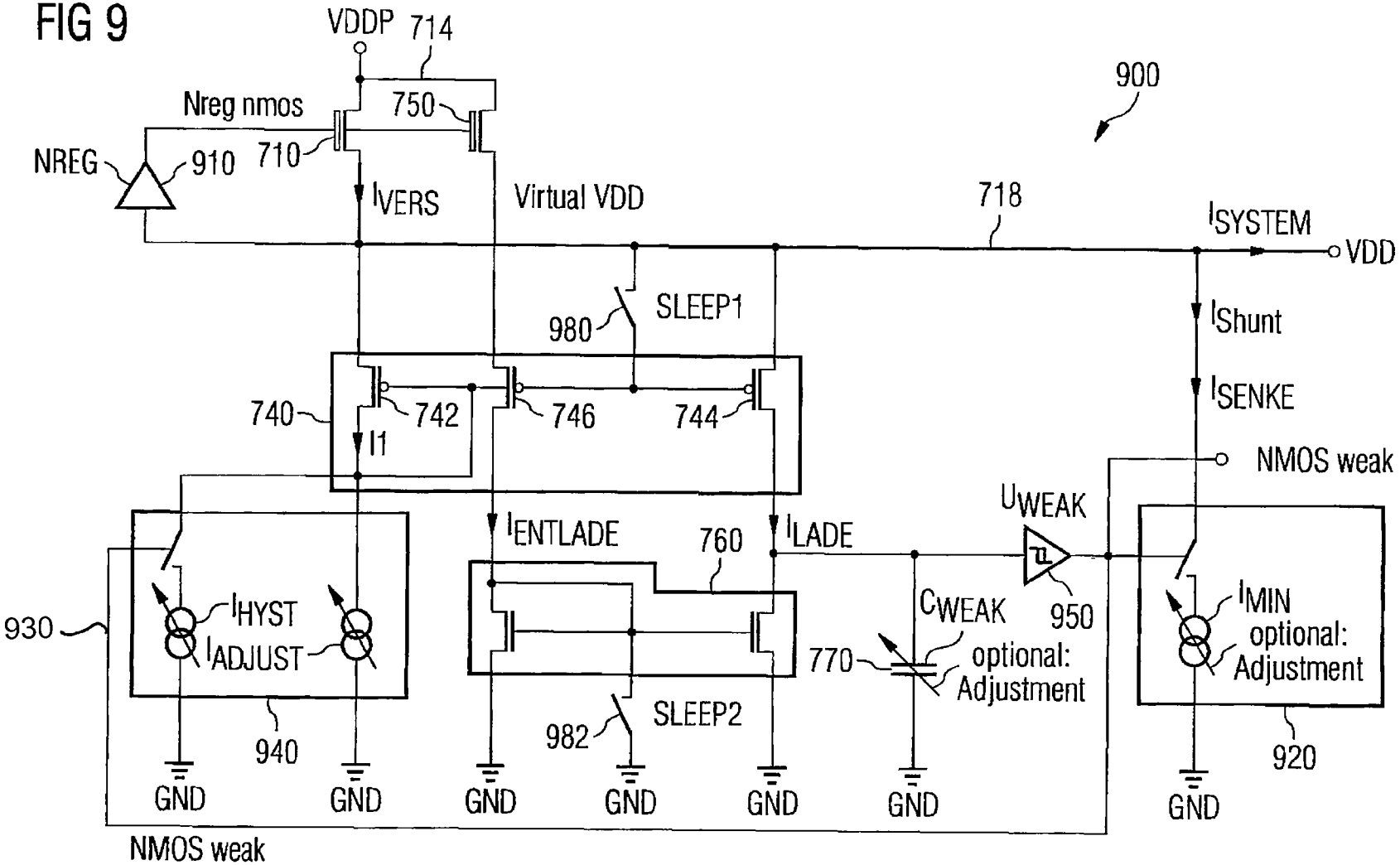
FIG. 9 shows a circuit diagram of a switching arrangement for creating a voltage-supply circuit according to the fourth exemplary embodiment of this invention using a programmable current sink as well as a switchable reference power source.

FIG. 9 shows a circuit diagram of another switching arrangement for carrying out the voltage-supply circuit according to the fourth exemplary embodiment of this invention using a programmable current sink as well as a switchable reference-voltage source. The switching arrangement of FIG. 9 is designated, in its whole, as 900 and can also be conceived as a programmable circuit for adjusting a minimum load ("programmable minload circuit") with a current hysteresis.

Since the switching arrangement 900 is similar to the switching arrangements 700, 800 described with reference to FIG. 7 and 8, identical means and variables in the switching arrangement 900 are designated by identical reference numerals as in the switching arrangements 700, 800. Therefore, a repeated description is omitted, and one should instead refer to the description of the switching arrangements 700, 800.

The switching arrangement 900 includes, in addition to the features already described above, a regulation-transistor activation circuit 910, which forms, together with the regulation transistor, a voltage regulation 710. The regulation-transistor activation circuit 910 (also called simply "regulator") is formed to adjust the voltage at the gate terminal of the regulation transistor 710 SO that the regulation transistor 710 delivers a supply current $I_{VERS}$, which is adapted to the current consumption of a chip provided with current by the (internal) second supply-voltage feed line 718. The regulation-transistor activation circuit 910 is advantageously formed to compensate the second supply voltage VDD present at the second supply-voltage feed line 718 to a constant value. To this end, the regulation-transistor activation circuit 910 can include e.g. a reference-voltage source, or be formed to receive a fixed reference voltage. The regulation-transistor activation circuit 910 can furthermore include an amplifier or an operation amplifier.

In the third switching arrangement 900, the switchable current sink 820 according to FIG. 8 is furthermore replaced by a switchable power source 920. The value of the current delivered can either be adjusted once and for all or be adjusted during the operation of the switching arrangement 900 through appropriate control signals to different values. A control signal 930 of the switchable power source 920, through which the switchable power source 920 can be switched on and off, is derived by means of a Schmitt trigger from the voltage at the second capacitor 770.

Furthermore, the power source 730 shown in the switching arrangements 700, 800 is, in the switching arrangement 900, replaced by a switchable power source 940, so that the current designated by $I_1$ in the switching arrangements 700, 800 can be adjusted as a function of the control signal 930 to at least two different values. The switchable power source 940, which is, in turn, coupled to an input of the arrangement 740, is formed to provide a first low current value when the switchable power source 920, which is coupled to the second supply-voltage feed line 718, is de-activated. The switchable power source 940 is furthermore formed to provided, based on the state of the control signal 930, a high or higher current value when the switchable power source 920 is activated.

In other words, the threshold-current value to which the supply current $I_{VERS}$ is compared in order to determine whether the regulation transistor 710 is at a low operating point is, according to the embodiment of the switching arrangement 900, increased when the switchable power source 920 is activated, in order to derive a current $I_{SENKE}$ (also designated by $I_{Shunt}$) from the second supply-voltage feed line 718 (e.g. towards the reference potential GND).

The current $I_{SENKE}$ provided by the switchable current sink 920 in the switched-on state and the two currents $I_{ADJUST}$ and $I_{ADJUST}+I_{HYST}$ provided alternatively by the switchable power source 740 are chosen in the switching arrangement 900 so that a hysteresis is obtained by switching the switchable power source 940. In other words, said currents are chosen so that a low operating point of the regulation transistor 710 is detected when the supply current $I_{VERS}$ falls below a lower threshold-current value the amplitude of which is fixed by the current $I_{ADJUST}$. Thus, if the supply current $I_{VERS}$ falls below the lower threshold-current value for a sufficiently long period (the period being determined by the size of the second capacitor 770), the switchable current sink 920 is activated. Hence, the supply current $I_{VERS}$ raises to the extent that the regulation transistor 710 is no longer at a low operating point. Simultaneously to the activating of the switchable current sink 920, the current $I_{ADJUST}$ provided by the switchable current sink 940 is however switched to $I_{ADJUST}+I_{HYST}$. This prevents a high operating point of the regulation transistor 710 from being signalled immediately after the activation of the switchable current sink 920 by the control line 930. Instead, the switching arrangement detects (immediately) after the activation of the adjustable current sink 920 a low operating point of the transistor, since the supply current $I_{VERS}$ is in the activated state of the switchable current sink 920 compared to a high threshold-current value, which is (at least in amount) higher than the lower threshold-current value, and which is fixed by the total current $I_{ADJUST}+I_{HYST}$. Thus, the switching arrangement 900 detects a low operating point of the regulation transistor 710 until the supply current $I_{VERS}$ rises, because of a rise of the current $I_{SYSTEM}$ absorbed by the remaining system, above the upper threshold-current value (whereby can apply e.g.: $I_{SYSTEM}=I_{LAST}$). The switchable current sink 920 is de-activated only after such a rise and simultaneously the switchable power source 940 is adjusted so that applies: $I_1=I_{ADJUST}$.

By means of the switching arrangement 900 shown, in which an activation of the switchable current sink 920 is accompanied by an increase of the threshold-current value (to which the supply current $I_{VERS}$ is compared) can thus be achieved a high stability of the switching arrangement according to invention. A time constant of the regulation transistor 710 is taken into consideration through an appropriate choice of a size of the second capacitor 770. Short-time disturbances are suppressed by the Schmitt trigger 950, which generates the control signal 930 from the voltage of the second capacitor 770, and an additional hysteresis is introduced by the switchable power source 940.

The attention is furthermore drawn on the fact that the second capacitor 770 can optionally be designed adjustable or switchable. Thus, the capacitor 770 can be adjusted or switched e.g. depending on whether a higher or lower operating point is present according to the control signal 930. This is advantageous, since it has been observed that the time constant of the regulation (comprised of the regulation transistor 710 and the regulation-transistor activation circuit 910) depends on the operating point of the regulation transistor 710. It is preferred to adjust the capacitor to a smaller value when the supply current $I_{VERS}$ adopts a high value (or when the control signal 930 signals a high operating point).

Furthermore, the current $I_{SENKE}$ provided by the switchable current sink 920 in the switched-on state can be adjusted e.g. as a function of the amplitude of a forthcoming load change, as has already been described above.

The Schmitt trigger 950 can, furthermore, optionally be omitted and replaced by threshold-value decision circuit without hysteresis. Furthermore, the Schmitt trigger 950 can also be omitted without being replaced, if the switches contained in the switchable current sink 920 and in the switchable power source 940 permit a direct control through the capacitor voltage present at the second capacitor 770. In this case, the signal present at a terminal of the second capacitor 770 directly constitutes the control signal 930. The Schmitt trigger 950 can also be replaced by a linear (eventually inverting) amplifier.

Furthermore, it is possible to switch the switching arrangement 900 into an inactive state or sleep state (also called "sleep state"). In order to obtain a sleep state, e.g. the gate terminals of the PMOS field-effect transistors 742, 744, 746 can be connected to the second supply-potential feed line 718. The gate-source voltage of at least the first PMOS field-effect transistor 742 and the second PMOS field-effect transistor 744 thus becomes zero, whereby a current flow through said transistors is prevented (provided the PMOS field-effect transistors are self-blocking).

In addition, it is furthermore possible to de-activate the current mirror 760. This can occur e.g. through connecting the gate terminals of the NMOS field-effect transistors of the NMOS current mirror 760 to the reference potential. In the embodiment shown of the current mirror, it is thus ensured that the current mirror permits no longer any current flow 760 from the second capacitor 770. Furthermore, in the described state, the second NMOS field-effect transistor 744 permits no longer any current flow to the second capacitor 770.

Thus, in the sleep state a charging and/or discharging of the second capacitor 770 is prevented, except for parasitic currents. Thus, a state of charging of the second capacitor remains 770 unchanged in the sleep state, except for parasitic effects. At the same time, the current consumption of the circuit is clearly reduced. The switches described above through which the PMOS field-effect transistors 742 and 744 or the current mirror 760 can be de-activated are furthermore designated by 980 and 982.

In brief, the operation of the switching arrangement 900 can be described as follows: Through the common gate voltage of the regulation transistor 710 and the operating-point determination transistor 750 a current is reflected to a virtual supply-voltage knot (virtual VDD) at the source terminal of the operating-point determination transistor 750 through a NMOS branch. The reflection of the current occurs in a way similar to a current limiting. The corresponding current, which constitutes a discharge current $I_{ENTLADE}$, is a predetermined fraction of the system current $I_{SYSTEM}$ (or of the supply current $I_{VERS}$) (and is e.g. in a range between one tenth of the system current and one ten thousandth of the system current). The current $I_{ENTLADE}$ is transmitted via the drain-drain path of the third PMOS field-effect transistor. The corresponding ratio (or the corresponding predetermined fraction) results from the scaling of the operating-point determination transistor 750 with respect to the regulation transistor 710. A channel width of the regulation transistor 710 is namely e.g. a predetermined multiple (e.g. within a range between tenfold and ten-thousand-fold) of a channel width of the operating-point determination transistor 750 (said ratio depending on the actual implementation).

The discharge current $I_{ENTLADE}$ discharges the second capacitor 770, which is also called $C_{WEAK}$. By the designation $C_{WEAK}$ is expressed that the second capacitor 770 is designed for detecting a low operating point. The discharge current $I_{ENTLADE}$ is transmitted via the current mirror 760 to the second capacitor 770.

A charge current $I_{LADE}$ is adjustable through a power source (the switchable power source 940) and charges the second capacitor 770. The charge current $I_{LADE}$ is constant (as long as the switchable power source 940 is not switched). Because of said currents (charge current $I_{LADE}$ and discharge current $I_{ENTLADE}$) the charging on the second capacitor 770 ($C_{WEAK}$) depends on the system current $I_{SYSTEM}$ (with which is provided one or more further circuit portions). The Schmitt trigger 950 generates a digital signal that signals when the NMOS regulation transistor 710 is at a low operating point, which means that the system current $I_{SYSTEM}$ is lower than the set minimum.

IF the system current $I_{SYSTEM}$ is too low (e.g. lower than the adjustable first current value or the lower threshold-current value $I_1$), a power source (the switchable current sink 920) is switched on. If the supply current $I_{VERS}$ reaches a second current value or upper threshold-current value $I_2$, the current load or the switchable current sink 920 is switched off. A hysteresis switches the current level for an activation of the minimum-load current source (minload-current source) to the first current value $I_1$.

The current flowing through the NMOS regulation transistor 710 thus remains above the first current value $I_1$. The time constant of the minimum-load circuit (minload circuit) can be chosen quickly, since a stability problem is relaxed by the regulation loop. The time constant must be faster than the time constant of the NMOS regulator. The time constant is, furthermore, advantageously slower than a few (e.g. 5 or 10) clock pulse cycles (of a circuit clocked by the second supply-voltage feed line 718), in order to compensate or smooth clock pulse peaks. The switched current (of the switchable current sink 920) is, furthermore, advantageously smaller than the hysteresis of the thresholds (thus of the distance in amount between the upper threshold-current value and the lower threshold-current value), in order to avoid an oscillation.

Figure 10:
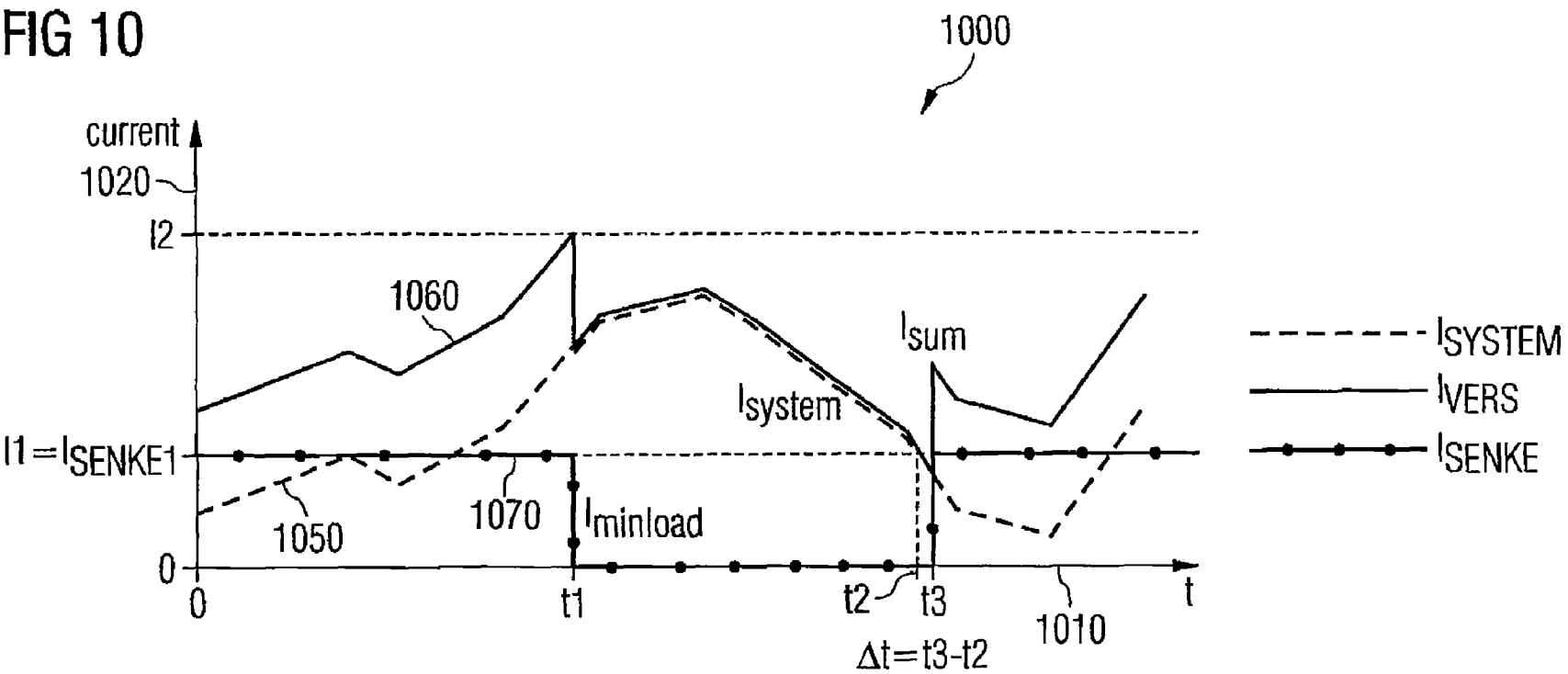
FIG. 10 shows a graphic representation of a current evolution in a voltage-supply circuit according to the fourth exemplary embodiment of this invention.

FIG. 10 shows a graphic representation of an exemplary current evolution in a voltage-supply circuit according to an exemplary embodiment of this invention. The graphic representation of FIG. 10 is designated by 1000. On an abscissa 1010 is shown the time. Furthermore, an ordinate 1020 shows the current.

A first curve 1050, shown in broken lines, describes the system current $I_{SYSTEM}$, which is absorbed by the switching arrangement fed with current by the second supply-voltage feed line 718. Furthermore, a second curve 1060 describes the evolution of the supply current $I_{VERS}$ flowing through the regulation circuit or the regulation transistor 710. The attention is drawn in this respect to the fact that the first curve 1050 and the second curve 1060 partly coincide, as will be described hereinafter. A third curve 1070 describes, furthermore, the evolution over time of a current $I_{SENKE}$ provided by the switchable current sink 920. At the initial moment (t=0), the switchable current sink 920 provides a current $I_{SENKE}=I_{SENKE,1}$ to the second supply-voltage feed line. Thus, the supply current $I_{VERSE}$ corresponds approximately to a sum of the system current $I_{SYSTEM}$ and the current $I_{SENKE}$ of the switchable current sink 920. The supply current $I_{VERS}$ follows the system current $I_{SYSTEM}$ with an offset that is fixed by the adjustable current sink 920, until the supply current $I_{VERS}$ reaches a value of $I_2$ (the upper threshold-current value), the corresponding moment being designated by t1. At this moment, the switching arrangement 900 detects the transition from the low operating point to the high operating point. The switchable current sink 920 is then de-activated, whereby the current $I_{SENKE}$ returns to 0. The supply current $I_{VERS}$ then coincides (except for a current consumption of the switching arrangement or activation-circuit arrangement 900) with the own current consumption or with the system current $I_{SYSTEM}$. Now, if the supply current $I_{VERS}$ reaches the threshold of $I_1$ (moment t2), the second capacitor 770 is charged. Hence, at a moment t3, the switchable current sink 920 is again activated ($I_{SENKE}=I_{SENKE,1}$), and the supply current $I_{VERS}$ flowing through the NMOS regulation transistor 710 increases by the corresponding value of $I_{SENKE}$. The difference in time $\Delta t=t_3-t_2$ is determined by the size of the second capacitor 770 as well as by the actual value of $I_{VERS}$ during the time interval between $t_2$ and $t_3$.

In other words, immediately (or with a small delay) after the supply current $I_{VERS}$ falls below the lower threshold value $I_1$, the switchable current sink 920 is activated, so that the supply current $I_{VERS}$ is again above $I_1$ (i.e. above the lower threshold-current value).

It is thus guaranteed that the supply current flowing through the regulation transistor 710 is at any time (except for the short time interval between moments $t_2$ and $t_3$) above the lower threshold value.

The attention is drawn on the fact that the current value of the switchable current sink 920 is higher than or equal to the lower threshold-current value (in the example shown: $I_1$). Furthermore, a hysteresis is defined by a difference between the upper threshold-current value (in the example shown: $I_2$) and the lower threshold-current value.

Figure 11A:
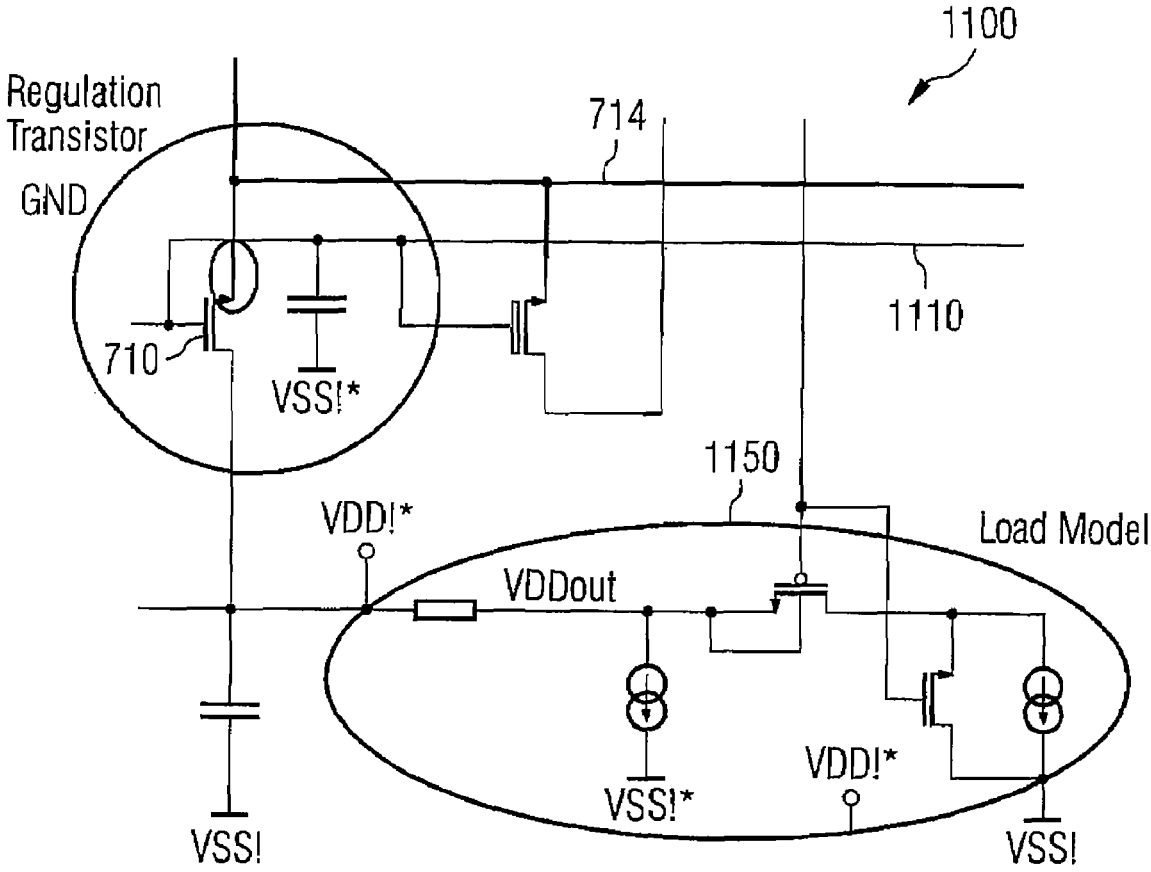
FIG. 11*a* shows a first portion of a circuit diagram of a voltage-supply circuit according to invention.
Figure 11B:
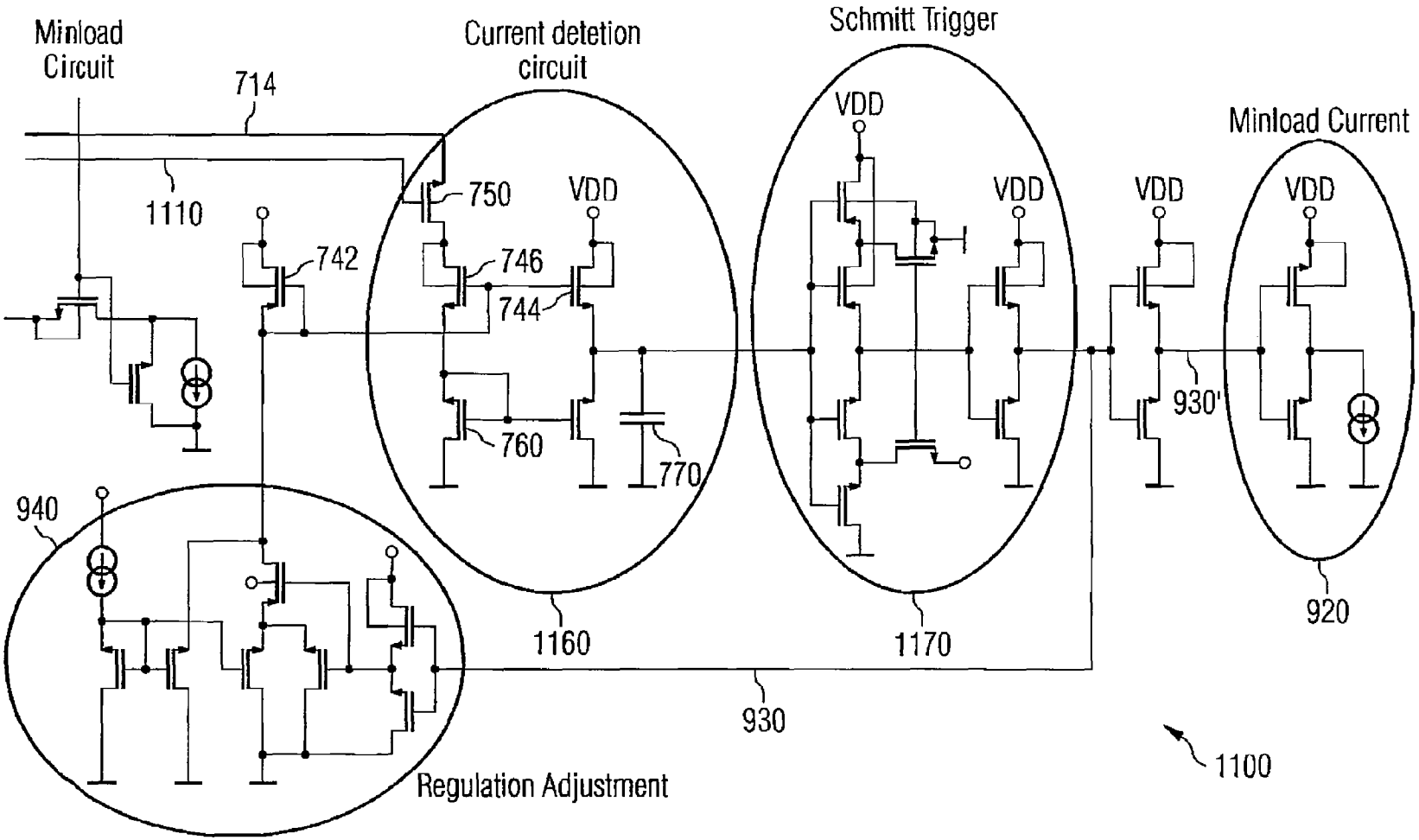
FIG. 11*b* shows a second portion of a circuit diagram of a voltage-supply circuit according to invention.

FIGS. 11*a* and 11*b* show, furthermore, a detailed circuit diagram of a voltage-supply circuit according to invention. The circuit diagram of FIGS. 11*a* and 11*b* is designated, in its whole, by 1100. Furthermore, the attention is drawn on the fact that the simulation results shown in FIG. 12 to 15 were generated using the switching arrangement 1100 shown in FIGS. 11*a* and 11*b*.

The switching arrangement 1100 substantially corresponds to the switching arrangement 900, so that identical means and variables in the switching arrangements 900 and 1100 are designated with by identical reference numerals and are not described separately here.

FIG. 11*a* shows, furthermore, the regulator (in particular the regulation transistor 710) and a load model 1150. The load model 1150 includes simple current sinks in the simulation. A small base current is invariably switched on. Furthermore, the load model includes a load, which is switched off when a current limiter detects a high current. In other words, when the current limiter detects that the supply current $I_{VERS}$ is higher than a permissible threshold value, the load is switched off, and only the small base current remains switched on in the load model. Furthermore, the attention is drawn to the fact that the load model is coupled to the second supply-voltage feed line 718, the supply voltage present on the second supply-voltage feed line 718 being regulated by the regulation transistor 710.

FIG. 11*b* shows, furthermore, a detailed circuit diagram of the minload circuit or minimum load circuit (minload circuit), which is formed to ensure a minimum current flow through the regulation transistor 710 (thus a minimum supply current $I_{VERS}$). The minload circuit can therefore also be designed as basic load circuit, which guarantees a minimum basic load for the regulation transistor 710.

A current-detection circuit includes, furthermore, the operating-point determination transistor 750 as well as the second PMOS transistor 744, the third PMOS transistor 746 and the current mirror 760. The current-detection circuit includes, furthermore, the second capacitor 770. The attention is drawn on the fact that the current-detection circuit is designated, in its whole, by 1160.

The switching arrangement 1100 shown in FIG. 11*b* includes, furthermore, a Schmitt trigger 1170, which corresponds to the Schmitt trigger 950 of the switching arrangement 900. The Schmitt trigger 1170 provides a control signal 930, which activates the switched power source 940. The switched power source 940 serves for adjusting trigger thresholds or levels (also called lower threshold-current value and upper threshold-current value). The adjustable power source 940 thus allows providing a hysteresis for the current-detection circuit 1160.

The switching arrangement 1100 includes, furthermore, also a switched current sink 920, which is activated by the control signal 930. The switched current sink 920 can be conceived as a power source for providing a minimum base current (minload current).

Furthermore, it can be seen from the switching arrangement 1100 of FIG. 11*b* that a switching level of the minload circuit is set in a simple feedback loop. The switching level determined by the switchable power source 940 depends on the value of the control signal 930. In other words, depending on the value of the control signal 930, the switched power source 940 provides at least two different currents to the first PMOS field-effect transistor 742, the current provided by the switchable power source 940 serving for adjusting a switching threshold of the current-detection circuit 1160. The switching threshold of the current-detection circuit 1160 refers to the supply current $I_{VERS}$ provided by the regulation transistor 710. Thus, the current-detection circuit 1160 in combination with the Schmitt trigger 1170 provides, as a function of the supply current $I_{VERS}$ and on the current provided by the switchable power source 940, the control signal 930, which, in turn, has an effect on the switchable power source 940.

Figure 12:
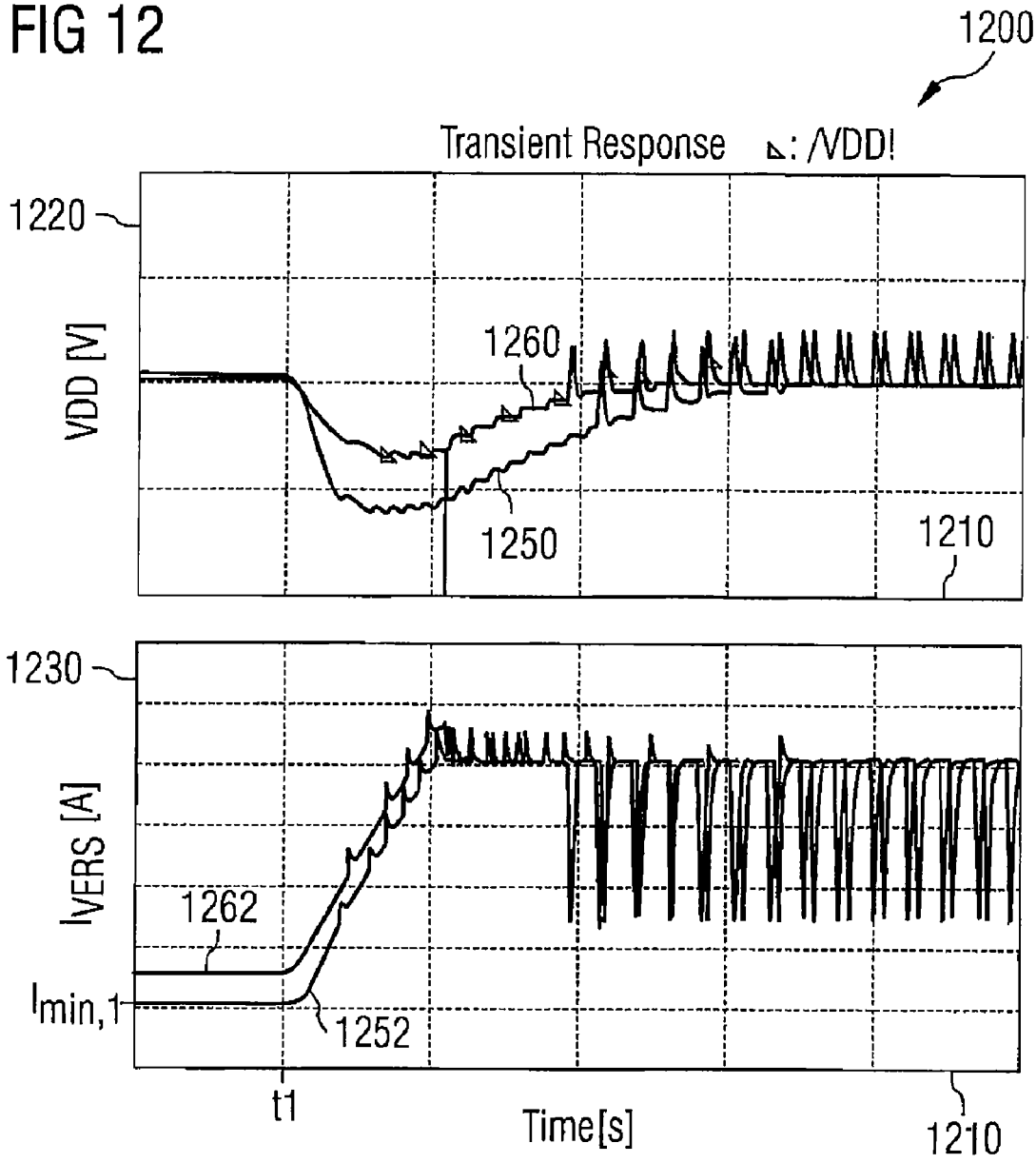
FIG. 12 shows a graphic representation of the voltage and current evolution when switching on a load, with and without the use of the concept according to invention.

FIG. 12 shows a graphic representation of the voltage and current evolutions when switching on a load, with and without the use of the concept according to invention. The graphic representation of FIG. 12 is designated, in its whole, by 1200. On an abscissa 1210 is shown the time.

A first ordinate 1220 describes a voltage at the second supply-potential feed line 718 (thus a voltage regulated by the regulation transistor 710). A second ordinate 1230 shows a supply current $I_{VERS}$ flowing through the regulation transistor 710.

The graphic representation 1200 describes altogether the switching on of a load in connection with a current limiter.

A first evolution curve 1250 describes the second supply voltage on the second supply-voltage feed line, which results when the concept according to invention is not used, thus when no switching arrangement for adjusting a minimum load (minload circuit) is used.

A second evolution curve 1252 describes the evolution of the supply current $I_{VERS}$, which results when a corresponding load change occurs without the use of a circuit for adjusting a minimum base current (minload circuit).

A third evolution curve 1260 describes the evolution of second supply voltage on the second supply-voltage feed line when switching on a load with an identical power consumption when the concept according to invention of a circuit for adjusting a minimum base current (minload circuit) is used. Furthermore, a fourth evolution curve 1262 describes the associated evolution over time of the supply current $I_{VERS}$.

In other words, the graphic representation 1200 shows a transient response to a change of a load with and without the use of a circuit for adjusting a minimum base current.

As can be seen from FIG. 12, the concept according to invention guarantees in the static case that before an increase of the power absorption (thus before the moment $t_1$) is present a minimum supply current of e.g. $I_{min,1}$. Without the use of the concept according to invention is obtained, instead, a minimum supply current $I_{VERS}$ of $I_{min,2}$, which is e.g. only one sixth of $I_{min,1}$ (cf. second evolution curve 1252 and fourth evolution curve 1262).

Furthermore, from the graphic representation 1200 can be seen that the second supply voltage collapses clearly further at the described load change when a circuit for adjusting a minimum base current is not used. If the switching arrangement according to invention is used, the second supply voltage collapses less, in comparison. In other words, through using a circuit according to invention for ensuring a minimum base current a collapse of the second regulated supply voltage on the second supply-voltage feed line can be reduced. A reliable operation of the circuit provided with the second supply voltage is thereby ensured.

Figure 13:
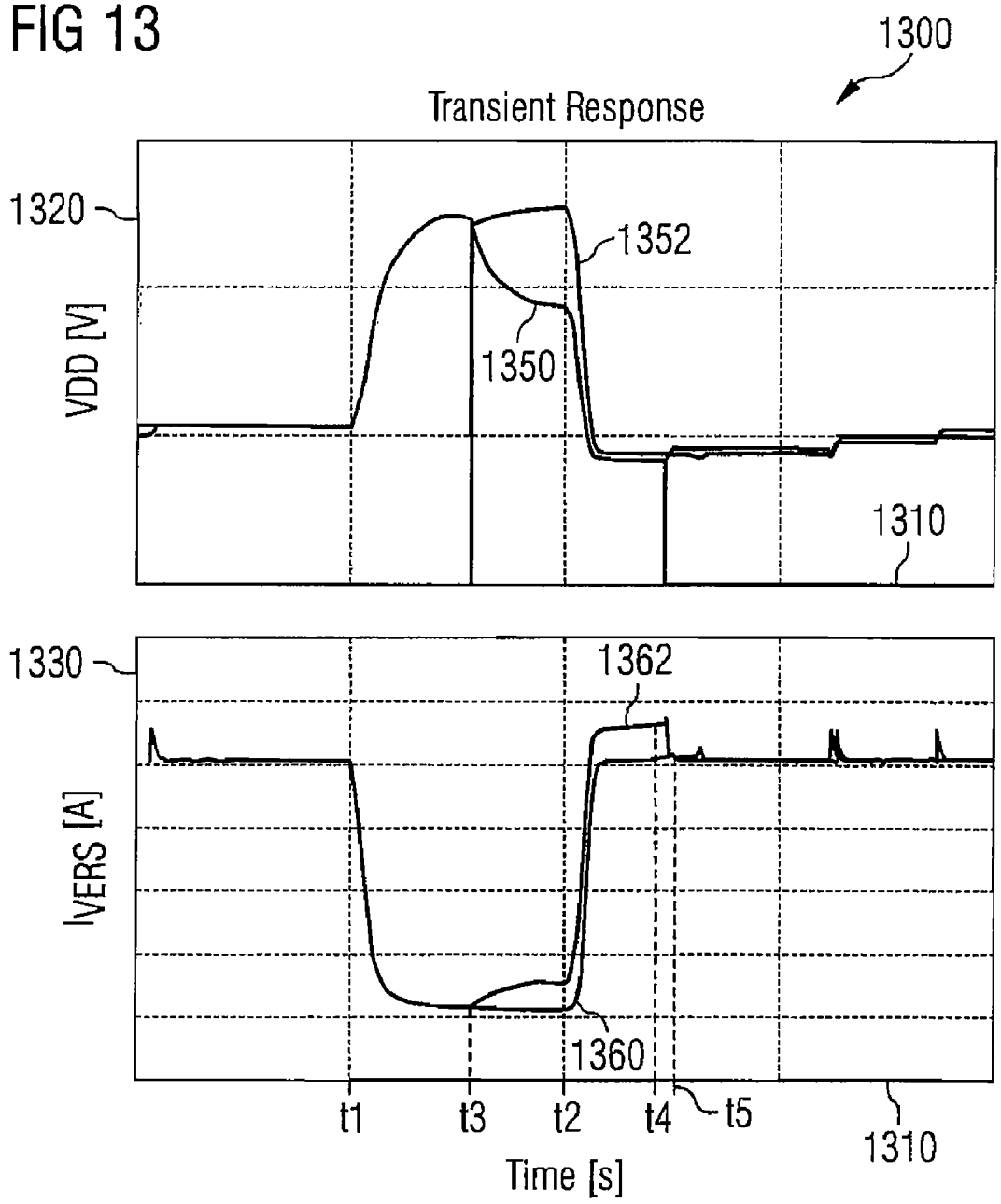
FIG. 13 shows a graphic representation of the voltage and current evolution in the case of a fast switching off and on of a load current, with and without the use of the concept according to invention.

FIG. 13 shows a graphic representation of the voltage and current evolutions at a fast switching on and off of a load current with and without the use of the concept according to invention.

The graphic representation of FIG. 13 is designated, in its whole, by 1300. On an abscissa 1310 is shown the time, the absolute time value being not important, while time differences instead are important.

On a first ordinate is shown the second supply voltage VDD. On a second ordinate 1330 is shown the supply current $I_{VERS}$ that flows through the regulation transistor. A first evolution curve 1350 describes the evolution of the second supply voltage VDD as a function of the time at a load change, when a switching arrangement for adjusting a minimum base current is not present or is at least not activated. A second evolution curve 1352 describes in a similar way an evolution of the second supply voltage VDD with an activated switching arrangement for adjusting a minimum base current (thus e.g. a switching arrangement 800, 900 or 1100). The attention is drawn on the fact that the first evolution curve 1350 and the second evolution curve 1352 partly coincide.

A third evolution curve 1360 describes the supply current $I_{VERS}$ as a function of the time in the case of a circuit for adjusting a minimum base current (minload circuit) is de-activated or not present. A fourth evolution curve 1362 finally shows, in a similar way, an evolution of the supply current $I_{VERS}$ when the circuit for adjusting a minimum base current is activated or present.

At a moment $t_1$, a load current is de-activated, after which the load current is again activated at the moment $t_2$. The evolution curves 1350, 1352 show that following the deactivation of the load current at the moment $t_1$ the second supply voltage VDD rises. After a renewed activation of the load current, the second supply voltage VDD drops again. The attention is drawn here on the fact that the current evolution shown is called fast switching off-on of the current. The time distance between switching on and switching off is so small that the regulation cannot compensate the voltage. If the switching arrangement for adjusting a minimum base current (minload circuit) is however active, the switching arrangement for adjusting a minimum base current begins to increase the total supply current $I_{VERS}$ flowing through the regulation transistor short after the current absorbed by the load drops. This can be seen e.g. in the fourth evolution curve 1362 between the moments $t_3$ and $t_2$. When the current absorbed by the load rises again (starting from the moment $t_2$), the current provided by the switching arrangement for adjusting a minimum base current (minload circuit) (e.g. the current $I_{SENKE}$) is switched off immediately or with a small time delay (cf. fourth evolution curve 1362 between the moments $t_4$ and $t_5$).

In other words, the switching arrangement for adjusting the minimum base current (minload circuit) is faster than the regulator and slower than a current limiter. The speed of said switching arrangement is determined e.g. by the size of the second capacitor 770 and by the switching time of the switchable current sink 820.

Figure 14:
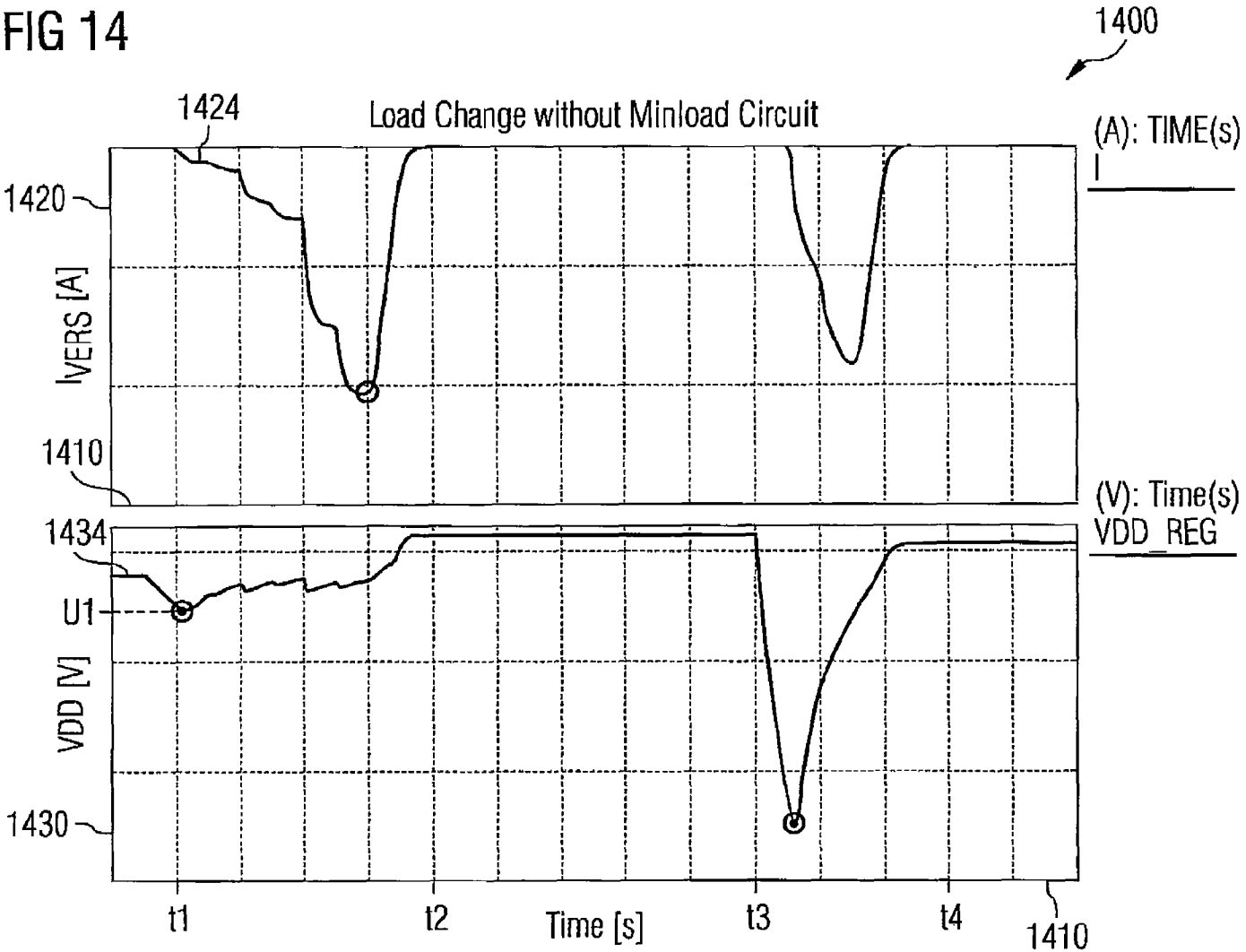
FIG. 14 shows a graphic representation of simulated voltage and current evolutions in the case of load changes using a conventional voltage-supply circuit.

FIG. 14 shows a graphic representation of simulated voltage and current evolutions in the case of load changes using a conventional voltage-supply circuit.

The graphic representation of FIG. 14 is designated, in its whole, by 1400 and shows the results of a system simulation without a so-called minload circuit.

An abscissa 1410 describes the time. A first ordinate describes a supply current $I_{VERS}$ flowing through the regulation transistor 710. In other words, the graphic representation 1400 describes with a first evolution curve 1424 an evolution over time of a current that is provided by a card reader to a chip card with a voltage-regulation circuit thereon for generating of a second internal supply voltage on a second supply-voltage feed line. Furthermore, on a second ordinate 1430 is shown the second supply voltage VDD. Therefore, a corresponding second evolution curve 1434 describes the evolution over time of the second internal supply voltage VDD, at the load change shown by the first evolution curve 1424.

The first evolution curve 1424, which describes the supply current $I_{VERS,}$ shows that the system is increased (ramped) from an infinitesimal power absorption to a system current. At a first load change, which occurs between the moments $t_1$ and $t_2$, the second supply voltage VDD drops to a minimum value $U_1$. After the load change, thus after the moment t2, the second supply voltage is too high, i.e. higher than the initial voltage. At a second load change, which occurs between the moments t3 and t4, the second supply voltage VDD collapses, instead, very strongly (cf. first and second evolution curve 1424, 1434).

It thus proves that in particular at the second load change shown, without the use of the minload circuit according to invention, the second regulated supply voltage collapses too strongly, so that a reliable operation of the circuit provided with the second supply voltage VDD is no longer guaranteed (since the circuit provided with the second supply voltage VDD necessitates e.g. a minimum voltage for a reliable operation).

Figure 15:
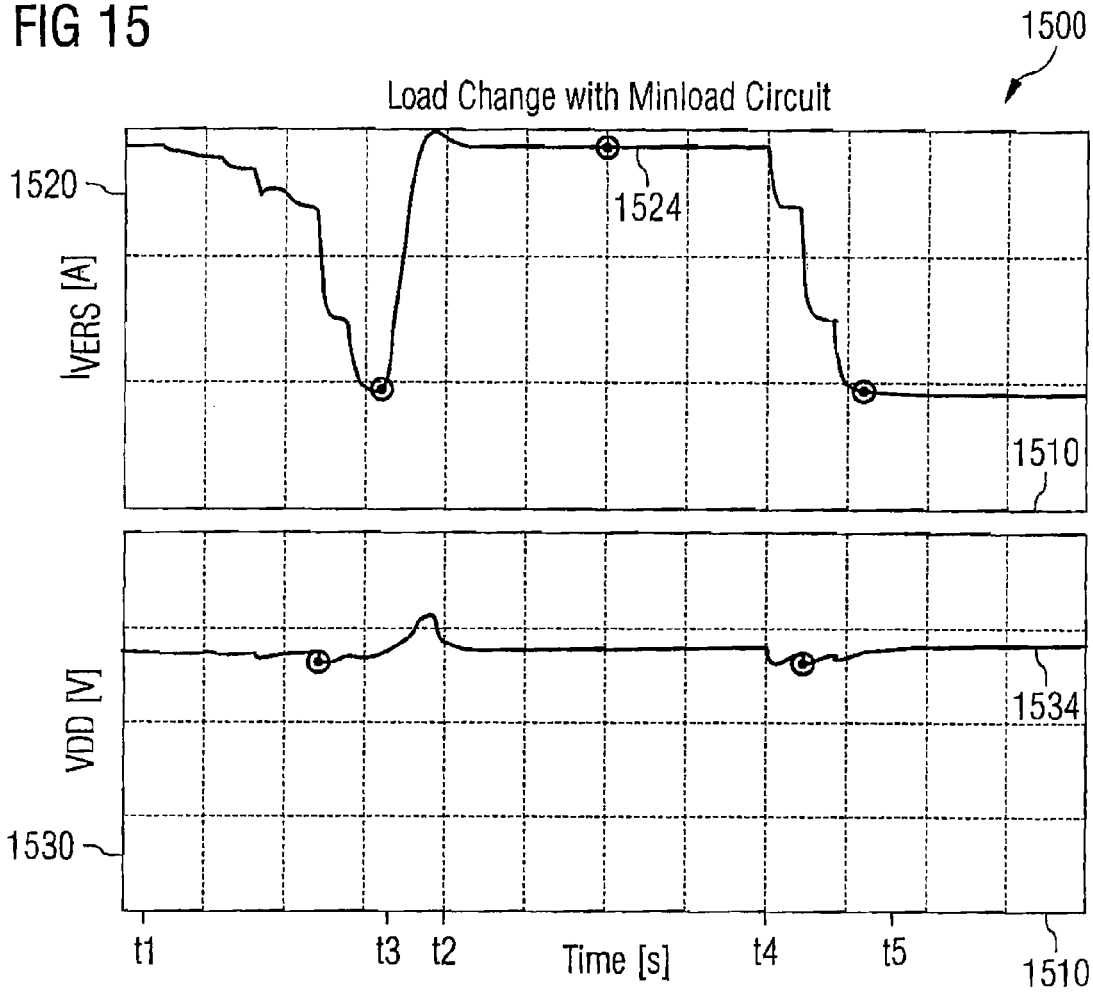
FIG. 15 is a graphic representation of simulated voltage and current evolutions in the case of load changes using a voltage-supply circuit according to invention.

FIG. 15 shows a graphic representation of simulated voltage and current evolutions in the case of load changes when using a voltage-supply circuit with a minload circuit according to invention. The graphic representation of FIG. 15 is designated by 1500. On an abscissa 1510 is shown the time. A first ordinate 1520 describes the supply current $I_{VERS}$. A first evolution curve 1524 describes the evolution over time of the supply current $I_{VERS}$ as a function of the time, a current consumption of the system (which is designated e.g. by $I_{SYSTEM}$ in the switching arrangement 900 of FIG. 9) of 0 (no power absorption) is increased (ramped) to a system current. A first load change occurs between the moments t1 and t2, the first load change describing both a rise of the current consumption (until the moment t3) and a drop of the power absorption (between the moments t3 and t2).

A second load change, which comprises only an increase of the system current $I_{SYSTEM}$ absorbed by the system, occurs between the moments t4 and t5.

The attention is furthermore drawn on the fact that the evolution curve 1524 thus describes a current, which is provided by a (card) reader to a chip card with a current-supply circuit according to invention.

A second ordinate 1530 describes, furthermore, an internal regulation voltage or internal second regulated supply voltage VDD. A second evolution curve 1534 thus describes the evolution over time of the regulated second supply voltage VDD as a function of the time.

From the graphic representation 1500 can be seen that at the first load change, when using the minload circuit according to invention, a determined voltage drop occurs. On the other hand, without the use of a minload circuit a higher (e.g. about twice as high) voltage drop occurs. After the first load change the tension is again compensated to the initial tension using the minload circuit according to invention. Without the minload circuit, after the first load change is instead obtained a regulated supply voltage, which is clearly higher than the initial voltage. At the second load change, a determined voltage drop occurs, when using the minload circuit according to invention. Without the minload circuit according to invention, a substantially higher voltage drop is obtained instead.

It thus proves that through the use of the minload circuit according to invention the regulator behaviour of the described voltage-regulation circuit can be substantially improved. By obtaining a base current that is also present when the system provided with the regulated supply voltage has a very low or no power absorption $I_{SYSTEM}$ can be achieved that a rise of the power absorption can be compensated quickly and with a comparatively small voltage drop. The corresponding regulation transistor is brought by the base current to a high operating point, at which it has a better regulator behaviour than at a low operating point with a low supply current. By providing a minimum base current, it is furthermore ensured that too large a regulated supply voltage present because of an overshooting of the voltage regulation is reliably diminished within a short period. A supporting capacitor, which is connected between the second internal supply-voltage feed line and the reference potential GND is namely discharged by the minimum base current, even when a system current $I_{SYSTEM}$ absorbed by the current-fed system is very low or equal to zero.

Figure 15A:
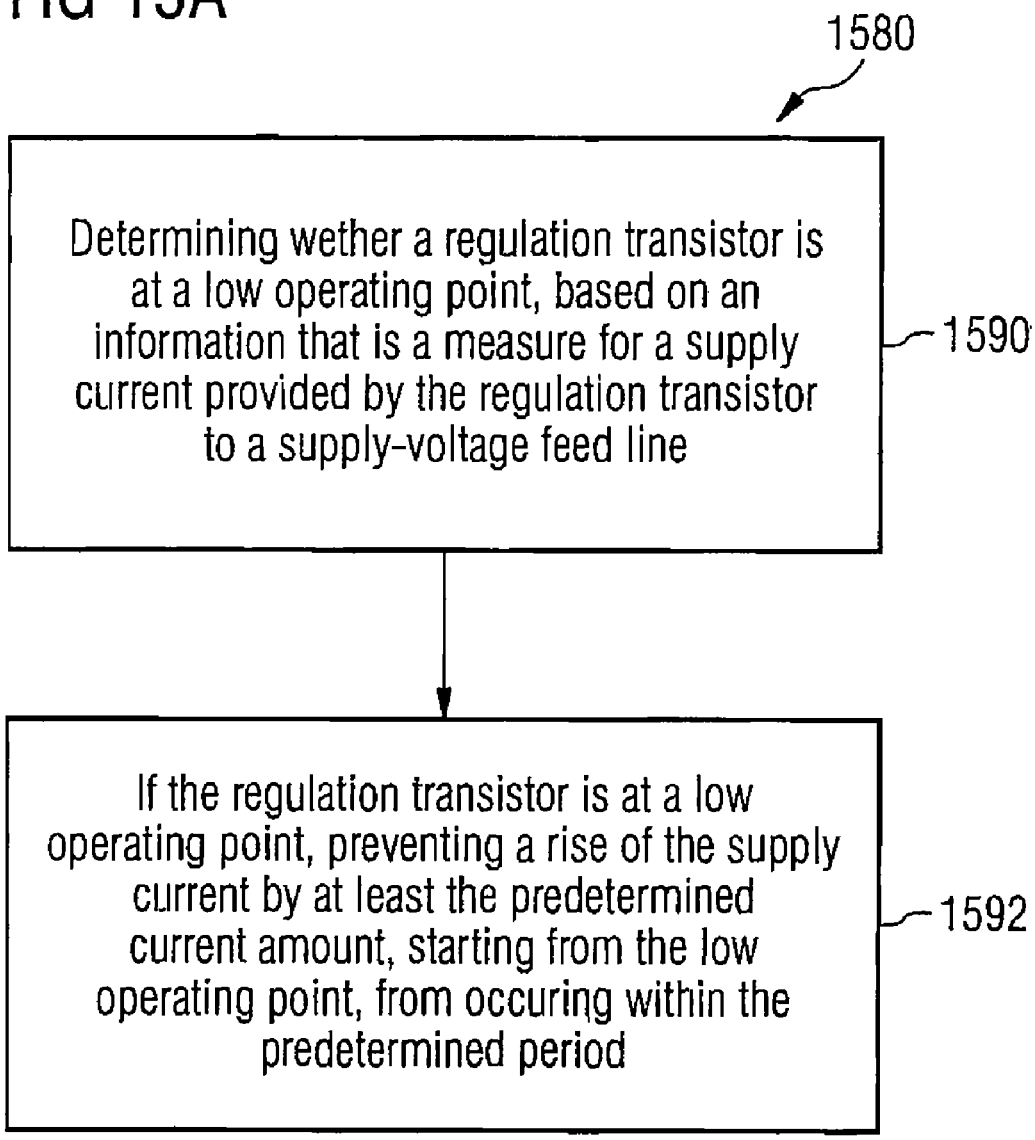
FIG. 15*a* shows a flow chart of a method according to invention for providing a circuit with a supply voltage.
Figure 16:
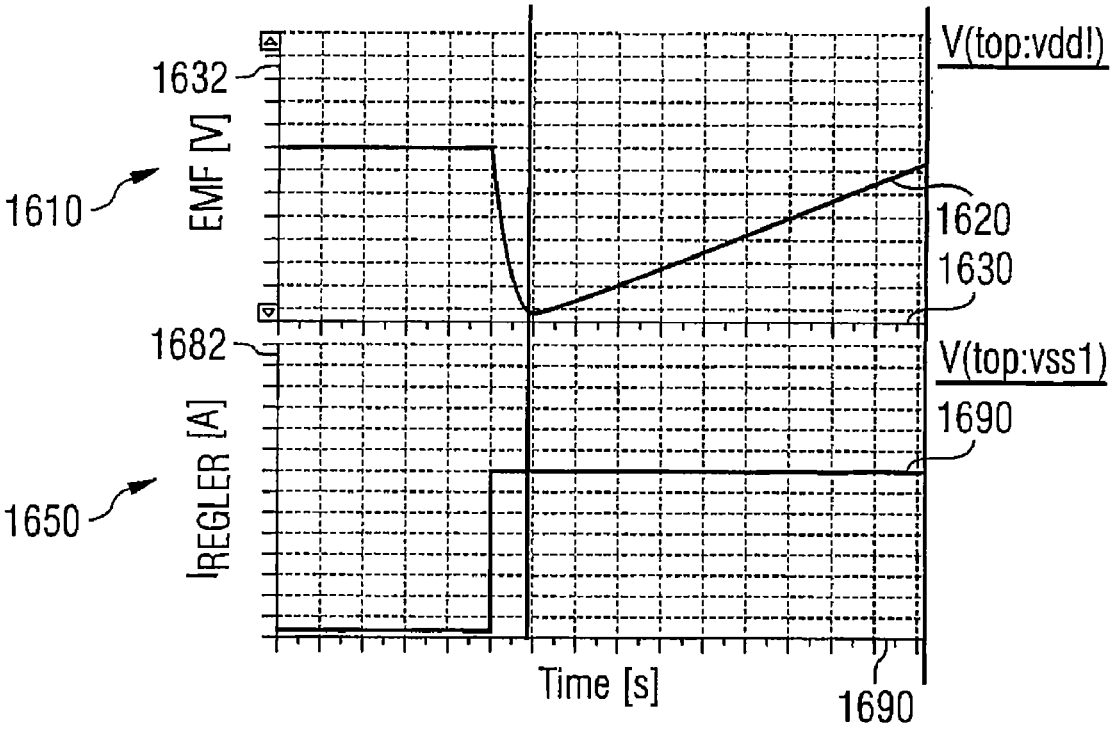
FIG 16 Prior Art
FIG. 16 shows a graphic representation of voltage and current evolutions for a load change using a conventional voltage-supply circuit.

FIG. 15*a* shows a flow chart of a method according to invention for providing a circuit with a supply voltage using a regulation transistor.

The method of FIG. 15*a* is designated, in its whole, by 1580. When performing the method 1580, it is assumed that a regulation transistor is connected between a first supply-voltage feed line and a second supply-voltage feed line, the regulation transistor being formed to regulate, based on a first supply voltage present on the first supply-voltage feed line, a second supply voltage present on the second supply-voltage feed line. The regulation transistor is formed to provide a supply current to the second supply-voltage feed line.

A low operating point of the regulation transistor is, furthermore, present when the supply current is below a determined current. In the case of a low operating point the second supply voltage would, furthermore, temporarily fall in amount below a predetermined permissible minimum voltage level if the current present on the second supply-voltage feed line (e.g. the current $I_{SYSTEM}$) would rise within a predetermined period by a predetermined current amount. Furthermore, below the predetermined permissible minimum voltage value a reliable operation of a circuit provided with the second supply voltage is no longer guaranteed.

The method according to invention comprises, in a first step 1590, determining whether the regulation transistor is at a low operating point. The determination occurs based on information that is a measure for an actual supply current provided by the regulation transistor to the second internal supply-voltage feed line.

A second step 1592 of the method according to the invention 1580 comprises preventing, starting from the low operating point, a rise of the supply current by at least the determined current amount from occurring within the predetermined period when the regulation transistor is at a low operating point.

In other words, it is guaranteed by the method according to invention that, starting the low operating point, the supply current does not rise so fast that the regulation (including the regulation transistor) is overburdened. It is thus achieved that the second supply voltage does not fall below the predetermined permissible minimum voltage value.

The method according to invention 1580 can, furthermore, comprise the steps that were described in the context of the description of the corresponding devices. In other words, the method according to invention can be supplemented so that the functionality of the switching arrangements described is achieved.

The attention is furthermore drawn here on the fact that the switching arrangements 300, 400, 500, 600, 700, 800, 900 and 1100 described above can be combined with each other. Coordination means can coordinate the individual measures (activating a base current, adjusting a clock frequency for a circuit component, activating only part of the system provided with the second supply voltage).

This invention thus creates a concept for providing a switching arrangement with a regulated supply voltage using a longitudinal regulation transistor through which inadmissibly high collapses of the regulated supply voltage are prevented. A reliable operation of a switching arrangement provided with the regulated supply voltage is thus ensured at any time.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

What is claimed is:

1. A voltage-supply circuit, comprising:

a regulator circuit, which is connected between a first supply-voltage feed line and a second supply-voltage feed line, and which is formed to regulate, based on a first supply voltage present on the first supply-voltage feed line, a second supply voltage present on the second supply-voltage feed line, the regulator circuit being formed to provide a supply current to the second supply-voltage feed line, wherein the regulator circuit comprises a regulation transistor which is connected between the first supply-voltage feed line and the second supply-voltage feed line to provide the supply current to the second supply-voltage feed line;

an operating-point determiner, which is formed to determine, based on information that is a measure for the supply current, whether the regulator circuit is at a low operating point at which the supply current is below a determined value, wherein at a supply current below the determined value the second supply voltage temporarily falls in amount below a predetermined permissible minimum voltage value below which a reliable operation of a circuit provided with the second supply voltage is not guaranteed if the current present on the second supply-voltage feed line rises by a predetermined current amount within a predetermined period; and a preventer, which is formed to prevent, starting from the low operating point, a rise of the supply current by at least the predetermined current amount from occurring within the predetermined period.

2. The voltage-supply circuit according to claim 1, wherein the operating-point determiner is formed to derive from the supply current a current that is a scaled image of the supply current, in order to compare the derived current with a reference current, and to detect a presence of a low operating point when the derived current is smaller than the reference current.

3. The voltage-supply circuit according to claim 2, wherein the operating-point determiner includes an operating-point determination transistor, which is structured similarly to the regulation transistor and which is scaled with respect to the regulation transistor so that a current flowing through the operating-point determination transistor is, at identical voltages present at the regulation transistor and the operating-point determination transistor, except for parasitic deviations, proportional to the supply current, the regulation transistor being furthermore formed so that a current flowing through the operating-point determination transistor is smaller than the supply current.

4. The voltage-supply circuit according to claim 2, wherein the operating-point determiner comprises a capacitor, and is formed so that a charging current of the capacitor is established by a difference between the derived current and the reference current, and the operating-point determiner is furthermore formed to decide, based on a capacitor voltage of the capacitor, whether the regulator circuit is at a low operating point.

5. The voltage-supply circuit according to claim 4, wherein the operating-point determiner includes a Schmitt trigger, which is formed to receive the capacitor voltage of the capacitor, and the output signal of which constitutes information on whether the regulator circuit is at a low operating point.

6. The voltage-supply circuit according to claim 1, further comprising a switchable current sink, which is coupled to the second supply-voltage feed line so that the supply current is increased by switching on the switchable current sink, wherein the voltage-supply circuit being formed to receive information on a forthcoming increase of a current absorbed by a load coupled to the second supply-voltage feed line, and to switch on the switchable current sink when an information is present indicating a forthcoming increase of the current absorbed by the load, and the regulation transistor is at a low operating point, and to otherwise switch off the switchable current sink.

7. The voltage-supply circuit according to claim 1, wherein the preventer is formed to activate a current-fed circuit provided with the second supply voltage so that a current absorbed by the current-fed circuit rises within the predetermined period by less than the predetermined current amount when the operating-point determiner indicates that the regulation transistor is at a low operating point.

8. The voltage-supply circuit according to claim 1, wherein the preventer is formed to activate a current-fed circuit provided with the second supply voltage so that a change of a current absorbed by the current-fed circuit that is higher than a predetermined barrier occurs stepwise when the operating-point determiner signals that the regulation transistor is at a low operating point, and, otherwise, not to exert an influence on a change of the current absorbed by the current-fed circuit.

9. The voltage-supply circuit according to claim 7, wherein the preventer is formed to adjust a clock frequency of a clock pulse provided to the current-fed circuit to a low value when the regulation transistor is at a low operating point, and to adjust the clock frequency of the clock pulse to a high value when the regulation transistor is not at a low operating point, and wherein the clock frequency of the clock pulse having an influence on a current absorption of the current-fed circuit.

10. The voltage-supply circuit according to claim 7, wherein the preventer is formed to block at least an inactive circuit portion of the circuit provided with the second supply voltage as long as the regulation transistor is at a low operating point, and to release the blocked circuit portion for activation when the regulation transistor is not at a low operating point.

11. The voltage-supply circuit according to claim 1, further comprising a switchable current sink, which is coupled to the second supply-voltage feed line so that the supply current is increased by switching on the switchable current sink, wherein the current-supply circuit is formed to switch on the switchable current sink when the operating-point determiner signals that the regulation transistor is at a low operating point, and to otherwise switch off the switchable current sink; and a current absorbed by the switchable current sink in the switched-on state is chosen so that in a switched-on state of the adjustable current sink the regulation transistor is not at a low operating point.

12. The voltage-supply circuit according to claim 11, wherein the operating-point determiner is formed to switch on the switchable current sink in response to a detection that a current derived from the supply current, the amount of which rises monotonously with an amount of the supply current, is smaller in amount than a first reference current, and to switch off the switchable current sink in response to a detection that the current derived from the supply current is larger in amount than a second reference current, the second reference current is higher in amount than the first reference current, and the first reference current and the second reference current are chosen so that the current derived from the supply current is lower in amount than the second reference current immediately after switching on of the switched current sink.

13. The voltage-supply circuit according to claim 12, wherein the operating-point determiner includes a capacitor, the voltage-supplier is formed so that a charging current of the capacitor is established by a difference between one of the reference currents and the derived current, and the operating-point determiner is formed to decide, based on a voltage present on the capacitor, whether the regulation transistor is at a low operating point.

14. The voltage-supply circuit according to claim 12, further comprising a switchable power source, which is formed to provide the first reference current when the operating-point determiner signals a high operating point, and to provide the second reference current when the operating-point determiner signals a low operating point.

15. The voltage-supply circuit according to claim 1, further comprising a controllable current sink, which is coupled to the second supply-voltage feed line so that a total current absorption of a system coupled to the second supply-voltage feed line can be adjusted by activating the adjustable current sink, and the operating-point determiner is coupled to the adjustable current sink and is formed to activate the adjustable current sink in order to set a constant total current absorption.

16. A method for providing a circuit with a supply voltage using a regulation transistor, which is connected between a first supply-voltage feed line and a second supply-voltage feed line, and which is formed to regulate, based on a first supply voltage present on the first supply-voltage feed line, a second supply voltage present on the second supply-voltage feed line, the regulation transistor providing a supply current the second supply voltage, the method comprising:

determining whether the regulation transistor is at a low operating point, based on information that is a measure for the supply current, the regulation transistor being at a low operating point when the supply current is below a predetermined value, wherein, at a supply current below the predetermined value, the second supply voltage temporarily falls in amount below a predetermined permissible minimum voltage value below which reliable operation of a circuit provided with the second supply voltage is not guaranteed if the current present on the second supply-voltage feed line rises by a predetermined current amount within a predetermined period; and preventing, starting from the low operating point, a rise of the supply current by at least the predetermined current amount from occurring within the predetermined period.

17. A voltage-supply apparatus, comprising:

a regulator means, which is connected between a first supply-voltage feed line and a second supply-voltage feed line, for regulating, based on a first supply voltage present on the first supply-voltage feed line, a second supply voltage present on the second supply-voltage feed line, and the regulator means for providing a supply current to the second supply-voltage feed line;

an operating-point determination means for determining, based on information that the operating-point determination means is a measure for the supply current, whether the regulator means is at a low operating point at which the supply current is below a determined value, wherein at a supply current below the determined value the second supply voltage temporarily falls in amount below a predetermined permissible minimum voltage value below which a reliable operation of a circuit provided with the second supply voltage is not guaranteed if the current present on the second supply-voltage feed line rises by a predetermined current amount within a predetermined period; and a prevention means for preventing staffing from the low operating point, a rise of the supply current by at least the predetermined current amount from occurring within the predetermined period.

18. The voltage supply circuit according to claim 1, wherein the second supply-voltage feed line is coupled to a load, so that a regulated supply voltage is provided to the load by the second supply-voltage feed line.

19. The voltage supply circuit according to claim 1, wherein the regulator circuit comprises a regulation-transistor activation circuit configured to adjust a voltage at a control terminal of the regulation transistor to compensate the second supply voltage to a constant value.

* * * * *